US007476791B2

(12) United States Patent
Parker

(10) Patent No.: US 7,476,791 B2
(45) Date of Patent: Jan. 13, 2009

(54) ORGANOSILANE SURFACE TREATED MUSICAL INSTRUMENT STRINGS AND METHOD FOR MAKING THE SAME

(75) Inventor: Anthony Parker, Newtown, PA (US)

(73) Assignee: Rohrbacher Technologies, LLC, Bordentown, NJ (US)

( * ) Notice: Subject to any disclaimer, the term of this patent is extended or adjusted under 35 U.S.C. 154(b) by 705 days.

(21) Appl. No.: 10/836,863

(22) Filed: Apr. 29, 2004

(65) Prior Publication Data

US 2005/0241454 A1 Nov. 3, 2005

(51) Int. Cl.
*G10D 3/10* (2006.01)

(52) U.S. Cl. ..... 84/297 S

(58) Field of Classification Search ..... 84/297 S, 84/297 R

See application file for complete search history.

(56) References Cited

U.S. PATENT DOCUMENTS 2,049,769 A 4/1936 Gray
2,892,374 A 6/1959 Ralls
4,063,674 A 12/1977 Stone et al.
4,539,228 A 9/1985 Lazarus
4,854,213 A 8/1989 Infield
5,252,655 A 10/1993 Parker et al.
5,578,775 A 11/1996 Ito
5,801,319 A 9/1998 Hebestreit et al.
5,907,113 A 5/1999 Hebestreit et al.
6,348,646 B1 * 2/2002 Parker et al. ..... 84/297 R
6,528,709 B2 3/2003 Hebestreit et al.
7,148,422 B2 * 12/2006 Hopper ..... 174/120 R

FOREIGN PATENT DOCUMENTS

JP 51126300 A * 11/1976
JP 58106597 A * 6/1983
JP 2003180882 A * 7/2003

* cited by examiner

*Primary Examiner*—Kimberly R Lockett
(74) *Attorney, Agent, or Firm*—Marshall & Melhorn, LLC

(57) ABSTRACT

An improved musical instrument string combines the attributes of superior corrosion resistance, low stiffness, and long life during storage and end use. Superior corrosion resistance is achieved through surface treatment of wound strings with an organosilane compound, where the preferred winding is a copper alloy such as phosphor bronze, and the preferred organosilane surface treatment comprises an aminotrialkoxysilane such as N-2-aminoethyl-3-aminopropyltrimethoxysilane.

27 Claims, 2 Drawing Sheets

ORGANOSILANE SURFACE TREATED MUSICAL INSTRUMENT STRINGS AND METHOD FOR MAKING THE SAME

BACKGROUND OF THE INVENTION

This invention relates to the construction and method for making organosilane surface treated musical instrument strings. More particularly, it relates to strings having superior corrosion resistance and longevity during storage and end-use, and low stiffness for improved playability and tonal quality. The present invention is particularly adapted for use with all stringed instruments including classical guitar, steel string guitar, titanium string guitar, violin, cello, dulcimer, banjo, mandolin, bass, piano, harpsichord, etc.

It is well known that strings under tension will vibrate when plucked, struck, or bowed at a characteristic fundamental frequency $f_1$, accompanied by a spectrum of n harmonic frequencies, all proportional to the tension and inversely proportional to the mass per unit length of the string (see, for example, Science And Music by Sir James Jeans, Dover Publications, Inc., New York, 1937, reprinted 1968). This relationship can be expressed for an ideal string of zero stiffness by equation 1:

$$f_n=(n/2\,\mathrm{L})(T/m)^{1/2} \quad [1]$$

where L is the speaking length of the string, T is the tension, and m is the mass per unit length. Note that in addition to the fundamental tone, a geometric series of lower-amplitude overtone vibrations are produced at integer values of n>1. These overtones excite a complimentary ensemble of instrument resonance frequencies whose amplitudes are dependent on both the type of instrument, and on the physical properties of the instrument's component materials. In fact, the overtones and the resultant resonance vibrations that they excite are responsible for each instrument's unique tone, or timbre. In addition, because they are lower in amplitude than the fundamental tone, the overtones are the first vibrations to be perceptibly dampened by 1) frictional losses from string corrosion byproducts, and ironically 2) by mechanical losses from polymer coatings and covers that otherwise are designed to slow down the corrosion of musical instrument strings.

Low frequency musical instrument strings are often helically wound with mass loading materials that are susceptible to corrosion, including alloys of copper, steel and nickel, so that the unit mass can be controlled within some "window of tension" without having to increase the speaking length or the mass of the core wire. Otherwise, the speaking lengths for bass strings would be unrealistically long, and/or the diameter and mass would be too high, leading to high stiffness, reduced tonal quality, and difficulty with fingering during instrument play.

The "window of tension" is determined in part by the construction and design of the instrument, and specifically by the cumulative tension that can be sustained when a plural set of strings is tuned to pitch. Thus, if the tension is maintained at too high of a value, the instrument can be permanently damaged. If the tension is too low, then unwanted resonances and buzzing noises may occur. For example, the cumulative tension for strings on a "classical guitar" is typically between 75 and 100 pounds, whereas the cumulative tension on a steel-stringed acoustic guitar can be as high as 190 pounds.

The most commonly used materials for the cores of wound musical instrument strings include polymers such as synthetic nylon, natural "gut"; and steel (for example, music spring wire that is currently manufactured according to ASTM A228 specifications). Other cores include those made with aramide fibers as disclosed in U.S. Pat. No. 4,854,213 to Infield (1989); those made with composite cores of fibrous materials such as carbon, ceramic, or metal as disclosed in U.S. Pat. No. 5,578,775 to Ito (1996); and those made with alloys of titanium as disclosed in U.S. Pat. No. 6,348,646 to Parker et al. (2002). Each of theses patents is incorporated herein by reference in its entirety.

Although the use of metal windings has historically enabled designers to control mass per unit length and hence pitch, one inherent problem with wound strings is that certain windings and cores tend to corrode during both storage and end use. This leads to increasingly higher frictional losses and vibrational damping, with the upper harmonic frequencies being particularly affected. Gradually, the tonal qualities deteriorate and the strings lose their "liveliness" and "brilliance." The problem may be partly related to stress relaxation from winding recoil, but it is also compounded by interfacial deterioration from corrosion at the core/winding interfaces, and from yielding of ductile interfacial materials such as tin or tin alloys.

Steel-core corrosion byproducts such as $Fe_2O_3$ are also weak oxides, and can easily spall, leading to mechanical losses and oxide particle contamination which can further dampen vibrations and negatively impact tonal quality. In addition, conventionally wound steel-core strings are often comprised of materials that are galvanically mismatched, and hence the propensity for corrosion is always present. Salt and moisture from human hand contact can create a type of salt-bridge that completes the potentially deleterious electrochemical couple between the winding and core. Collectively, these problems ultimately lead to what many musicians recognize as a "dead" string.

Many conventionally wound strings also have a limited shelf-life, and often require special packaging considerations and/or storage conditions to prevent corrosion, and to preserve their tonal characteristics prior to use. In some cases, strings that have been stored for long periods can become weakened from corrosion, and can break when attempts are made to tune the strings to pitch. In other cases, the otherwise "new" strings can exhibit the tonal characteristics of "dead" strings simply because they were stored too long before use.

Several prior art examples have attempted to address one or more of these issues through methods and constructions aimed at improving the longevity of wound strings. For example, U.S. Pat. Nos. 5,883,319; 5,907,113; and 6,528,709 to Hebestreit, et al. (1999, 2003) disclose wound and non-wound musical instrument strings that are covered with a porous polytetrafluoroethylene polymer over a portion of the speaking length, or over the entire speaking length of the string for the purpose of providing corrosion resistance, comfortable play, less finger noise, and longer life (these strings are commercially available from W. L. Gore & Associates, Inc.). U.S. Pat. No. 5,801,319 to Hebestreit, et al. (1998) teaches that the mass of said coverings represent approximately 3% of the mass of the entire covered string. Thus, since the cover traverses the speaking length of the string, its mass therefore modulates the tonal and dampening characteristics accordingly.

U.S. Pat. No. 2,892,374 to Ralls (1959) discloses a conditioning process where a musical instrument string with a metallic winding wrapped about a gut core is treated by soaking the strings in a polymer lacquer solution to coat the core and to fill the interstitial spaces between core and windings along the entire speaking length of the string. The purpose is to prevent shrinkage of the gut core and to prevent loosening of windings during end use, both of which lengthen string life. Similarly, since the polymer traverses the entire speaking length, tonal quality, stiffness, and playability are affected accordingly.

U.S. Pat. No. 2,049,769 to Gray (1936) discloses a string constructed with a polymeric, varnish-reinforced fabric that encircles a straight or kinked metal core along its entire length to form a unitary string body. Metal windings can be incorporated either between the fabric and core, or they can be wrapped around the unitary composite core. This string owes its properties to its composite nature, where the fabric is incorporated to carry a portion of the tensile load in concert with a steel core wire. The polymer and fabric traverse the entire speaking length, so tonal qualities, dampening, stiffness, and playability are all affected.

U.S. Pat. No. 4,539,228 to Lazarus (1985) discloses a method for treating wound musical instrument strings to reduce the "break-in period" and to extend useful life by filling microscopic pores, cavities, and interstitial spaces of wound strings with dry lubricant particles, moisture displacement agents, and a corrosion inhibitor, where the proposed corrosion inhibitor is broadly described as being comprised of a parafinic oil and a wetting agent. Although the use of a corrosion inhibitor is generally discussed, no insight is provided with respect to the effects of molecular structure on chemisorption, passivation, and corrosion inhibition; nor is insight provided with respect to the effects of galvanically mismatched materials on the efficiency of corrosion inhibition. Thus, although the concept of corrosion inhibition is recognized to be of value, no insight is provided with respect to the molecules and surface concentrations that could be appropriate for protecting metals that are subject to the galvanic conditions that are specific to a musical instrument string's metallic construction and composition. Of equal importance, the dried particulates are chosen so as to fill the interstitial spaces between the windings, and to traverse the speaking length of the string. These non-bonded particulates are therefore expected to modulate the tonal and dampening characteristics accordingly.

U.S. Pat. No. 6,348,646 to Parker et al. (2002) discloses strings comprised of titanium alloy cores (commercially available from Rohrbacher Technologies at www.rohrtech-.com), wherein both wound and non-wound strings have superior corrosion resistance and low stiffness for improved playability. Unlike traditional steel-core strings, the titanium core string is comprised of a relatively cathodic metal core (cathodic because titanium metal is passivated with a thin oxide layer), and a second metal winding wire, where the difference in galvanic potential between the two metals (as measured by the difference in galvanic potential with respect to a saturated calomel electrode in seawater) is as close to zero as possible. The best corrosion resistance is achieved when the core and winding wires are similar in galvanic potential, and when the core is the more cathodic member of the coupled pair. Consequently, superior corrosion resistance is achieved with nickel wound titanium alloy core strings, where the galvanic mismatch is essentially nil. Excellent corrosion resistance is also achieved with copper-alloys wound about titanium-alloy cores, particularly when the strings are surface treated with an azole compound.

However, copper alloys such as brass and phosphor bronze still have the propensity to corrode, even when the cores of the strings are comprised of titanium alloys, and even when the strings are surface treated with azole compounds. Thus, although azole surface-treated titanium-alloy strings provide a substantial improvement over the prior art, there still exists a need for methods by which to further improve the corrosion resistance and longevity of all musical instrument strings that are wound with copper alloys.

Coatings, covers, lacquers and the like have been used in attempts to arrest the corrosion process. Unfortunately, such coatings also reduce the brightness of the strings during use. Again, the perceived brightness of a string arises from its ability to excite the resonance vibrations of a musical instrument. Anything that interferes with these vibrations will deteriorate sound quality. Thus, corrosion byproducts, contamination from finger contact, and even coatings that are designed to help prevent corrosion can all contribute to the dampening of string vibrations.

It is generally known that corrosion of the anodic component in a galvanic couple is accelerated as the ratio of the surface area of the cathodic metal to the anodic metal increases (Metals Handbook Desk Edition, second edition, J. R. Davis-Editor, ASM International, Materials Park, Ohio, 1998). In the case of conventionally wound steel core strings, the steel core is typically the more anodic of the coupled pair, and it also has the least amount of exposed surface area. Even worse, the iron oxides that form at the anode are mechanically weak oxides, which easily spall, leading ultimately to shearing motions and contamination at multiple interfaces, and vibrational dampening in the form of frictional heat dissipation. In order to minimize corrosion, it is desirable to either construct the string with electrochemically equivalent materials, or if some degree of galvanic coupling is inevitable, to design the string by minimizing the surface area of the cathodic member. This condition is satisfied when the core member is comprised of titanium or a titanium alloy. In addition, regardless of which member is more anodic or cathodic, it is generally desirable to passivate or protect the interfaces of the most corrosion-prone component members, especially when a galvanic mismatch exists.

The oxide layer that forms on the surface of metals in air is a protective layer that itself can inhibit the corrosion process. It is known to those skilled in the art of surface chemistry and corrosion inhibition that certain metal oxide layers are durable and resistant to hydrolysis, permeation, and mechanical wear. Metals that form these types of oxide layers are by nature extremely corrosion resistant (titanium and its alloys fall into this category). On the other hand, if the protective oxide layer that forms on a metal is mechanically weak, and/or if it is prone to hydrolysis and moisture/oxygen permeation, then the protective layer may spall and expose fresh metal surfaces which in turn are prone to continued oxidation (iron and, to a lesser degree, copper alloys fall into this category). This cycle, otherwise known as corrosion, continues at a rate that depends on many environmental factors, as well as on the inherent properties of the metal.

One generally accepted method of protecting a metal from corrosion is to use a corrosion inhibitor to chemically stabilize the protective oxide layer on the metal surface. A good corrosion inhibitor generally chemisorbs onto the metal oxide surface to form a stable chemical bond (the bond can be covalent or ionic in character). The formation of a bond can often be observed spectroscopically through the use of surface analytical techniques that are known to those skilled in the art (i.e., FTIR, ESCA, etc.). Some of the best corrosion inhibitors have been found to form surface complexes that are resistant to hydrolysis, oxygen permeation, water permeation, and dissolution. This is the generally accepted mechanism by which azole compounds are thought to protect the surfaces of copper alloys. In fact, spectroscopic evidence has shown that azole compounds form protective organo-cupric polymeric complexes that resist dissolution and moisture permeation (see for example, J. B. Cotton and I. R. Scholes, *Brit. Corrosion J,* 2, 1-5, 1967; and J. C. Rubim, *Chem. Phys. Lett.,* 167, 209-214, 1990).

The protective polymeric complexes are formed when certain azole compounds are either deposited from solution onto the surfaces of copper alloys, or when the copper alloys are stored in contact with azole treated paper packages. Importantly, this type of treated paper is often used to cover and protect spools of copper alloy wires that are used to construct musical instrument strings. In addition, azole impregnated paper is often used to make the familiar envelopes that are used to store many types of musical instrument strings.

Although chemisorption is recognized as an important factor in corrosion inhibition, it can also be detrimental. In fact, some chemisorbed compounds actually accelerate the corrosion of metals. For example, this can happen when the resultant chemisorbed complex is more water-soluble and is less resistant to permeation than the original oxide layer. This is why certain acids and bases can have a deleterious effect on metal corrosion. For example, certain primary amine compounds, including ammonia, readily attack copper alloys. Thus, chemisorption alone does not guarantee that a compound will inhibit corrosion.

Many steel cores for wound guitar strings are typically surface treated with malleable metals such as tin, tin alloys, gold, or silver for the purpose of decreasing the rate of corrosion, and for helping to maintain initial winding tightness. For example, U.S. Pat. No. 4,063,674 to Stone and Falcone (1977) discloses a method of manufacture whereby a wound string assembly is heated at an elevated temperature for various amounts of time to produce a string where windings are more evenly spaced. The coefficient of thermal expansion of the core is less than that of the winding, and the core is coated with a material having a melting point lower than the heat treatment temperature. The invention discloses a tin coating that upon heating, can be used to form a metallurgical bond between winding and core.

It is generally known that surface coatings such as tin can reduce the galvanic couple between steel and other metallic materials, but corrosion is not entirely prevented (see for example McKay, R. J. and Worthington, R., Corrosion Resistance of Metals and Alloys, American Chemical Society Monograph Series, Reinhold Publishing Corporation, New York, 1936). The malleability of tin can enable it to yield and partially encase the winding during processing to help maintain initial tightness. However, this same attribute can also be a long term detriment since the ductility of tin renders it susceptible to yielding under the recoil stress of the windings, a problem which is further aggravated by corrosion since bi-products may further weaken the material near the chemically dissimilar interfaces. Thus, short term durability and ultimate interfacial failure are simultaneously and paradoxically inherent to the structural design of many conventional metal wound steel core strings.

In cases where polymers or lacquers have been used to either slow corrosion or to maintain winding tightness, they traverse either a portion of, or the entire speaking length of the string, and thus they influence the tonal and dampening characteristics of the string.

Alternatively, lower density polymeric strings such as gut and nylon are not susceptible to corrosion, and are used either alone or as the cores for metallic or polymeric wound strings. However, the metallic windings that are sometimes used in combination with these cores are still susceptible to corrosion.

Accordingly, it would be desirable and advantageous to develop a surface treated string construction wherein the use of sound dampening polymeric materials, covers, lacquers and particulates is minimized or eliminated over the speaking length of the string. In addition, it would be further advantageous to choose a surface treatment that chemisorbs to form a stable, moisture and heat resistant bond that resists dissolution, wear, and dimensional change during manufacturing, during storage, during tuning, and during end-use. Furthermore, in the event that a galvanic couple between the contact metal surfaces is inevitable, then it would be desirable for the lowest surface area member (the core) to be the more cathodic member of the surface treated construction.

Accordingly, a primary object of the present invention is to provide a surface treated wound metallic musical instrument string with combined attributes of high corrosion resistance, and durability.

Another object is to provide a low-stiffness, surface treated, corrosion resistant musical instrument string having the associated benefits of low stiffness, including ease of play, and better tonal qualities.

Another object is to provide a musical instrument string with the benefits of improved corrosion resistance including longer shelf life before use, and longer life during end use.

Yet another object of the present invention is to provide a method for manufacturing the strings of this invention whereby the resultant surface treated string provides optimum corrosion protection both during manufacture and in end use.

Still another object is to provide a method for maintaining a high degree of corrosion resistance without the use of dampening polymeric covers within the speaking length of the string.

These and other objects and advantages of the present invention will be more fully understood and appreciated with reference to the following description.

SUMMARY OF THE INVENTION

The present invention relates to an improved musical instrument string for use on instruments including but not limited to guitars, violins, mandolins, cellos, pianos, basses, etc. This invention is particularly suitable for use on instruments where the strings are handled during play such as guitars, basses and other hand held stringed instruments.

The surface treated string of the present invention employs a polymeric, ceramic, or metallic core wire that is spirally wound with another metallic wire (to control mass per unit length, and hence pitch at equivalent tension). When metallic cores are employed, the preferred construction is one where the core wire is the more cathodic member of the coupled pair. Although this condition is not mandatory, the greatest benefit of the preferred surface treatment is realized when this condition is met. Thus, in one preferred embodiment, the metallic core string comprises a metal core of a titanium alloy wire, and a copper alloy winding wire such as brass or phosphor bronze, wherein at least one member and preferably both are surface treated with an organosilane compound.

Although other cores can be used in this invention (i.e., steel, stainless steel, and nylon), titanium cores provide several unique benefits. For example, steel-core strings that are treated with the preferred organosilane exhibit improved corrosion protection, but analogously treated titanium alloy-core strings resist corrosion for much longer durations of time. Also, the lower density of the titanium-alloy core translates to the additional benefits of reduced tension at pitch, and easier playability. The lower modulus also equates to lower stiffness at an equivalent diameter core, which translates to improved tonal quality, and easier fretting during instrument use.

The preferred organosilane in the present invention is one that can chemisorb to form a durable bond with the treated metal interface. Further, the chemisorbed treatment should be durable and resistant to hydrolysis, mechanical wear, temperature fluctuations, and stresses that are induced during manufacture, and during end use. In addition, the organosilane surface treatment should have a high level of efficiency so that corrosion protection is afforded at negligibly low surface concentrations. In this way, the surface treatment will have little to no affect on tonal qualities.

One type of organosilane, which surprisingly satisfies these criteria, is an aminosilane, a specific example of which includes N-2-aminoethyl-3-aminopropyltrimethoxysilane. The utility of an aminosilane in this application is quite unexpected, especially in light of several published accounts that have documented unsuccessful attempts to use it as a corrosion inhibitor. This lack of success has perhaps prompted researchers and inventors to overlook a subtle nuance that has become a surprising discovery of the present invention. Namely, the aminosilane of the present invention provides superior corrosion protection when it is chemisorbed, and when a substantial fraction of its amine groups exist in a non-protonated form. Conversely, it has been surprisingly found that corrosion is accelerated when a substantial fraction of the aminosilane groups are protonated. Thus, the most preferred aminosilane is one that is chemisorbed in such a way so as to insure that a substantial fraction of its amine groups remain non-protonated. Although not wishing to be bound by any one theory, it appears that an aminosilane provides improved corrosion protection when its amine moieties are free either to associate or to chelate with the metal oxide surfaces. In this way, the compound has the potential to stabilize the passivating (protective) metal oxide layers, perhaps rendering them less susceptible to moisture and oxygen permeation. As a complementary theory, it is also possible that a high fraction of protonated amines could lead to an increase in the water/electrolyte permeability of the protective layer. Such permeation could actually enhance the dissolution of the protective oxide layer, which in turn would accelerate the corrosion process. This could be one explanation for the worse corrosion behavior that is unexpectedly observed when the chemisorbed aminosilanes are comprised of a high fraction of protonated amines.

In addition, it has been discovered that the method of aminosilane surface treatment has a profound effect on the resulting chemical state of the amine groups, which in turn affects the corrosion resistance of the treated string. Namely, a dilute solution deposition process has been found to unexpectedly favor the formation of the preferred non-protonated species, whereas a more concentrated solution deposition process has been surprisingly found to favor the formation of the deleterious protonated species. Thus, the preferred method of manufacture is one that favors the deposition and chemisorption of a substantial fraction of non-protonated amines, with dilute solution deposition being one preferred embodiment of this concept.

The preferred strings of this invention have been found to exhibit superior characteristics including excellent corrosion resistance, excellent tonal characteristics, longevity during end use, and excellent thermo-mechanical stability. The enhanced corrosion resistance made possible by this invention greatly increases string shelf-life, which is a positive benefit for manufacturers and distributors, who otherwise have gone to great extremes to develop special and costly packaging and coatings to protect strings from the elements that cause corrosion. Equally important, the corrosion resistance afforded by this invention makes it possible for strings to have longer life during use, since the strings of this invention will resist the otherwise detrimental effects of moisture and ions from dissociated salts, organic acids, and other contaminates that originate from human hands during instrument use.

The string of the present invention may be manufactured by conventional means (continuous or discontinuous winding processes), and is affixed with appropriate end-fittings, including sheathings, swage, ball ends, etc. The organosilane surface treatment can be applied to one or both members individually before winding, or to the finished wound string via processes known to those skilled in the art including but not limited to continuous dip coating, solution batch coating, roll coating, plasma coating, etc.

Multiple organosilanes can be optionally used to individually treat separate members. In addition, mixtures of organosilane compounds can be optionally employed to treat any one member prior to winding, or to treat the finished wound string.

As an optional embodiment, a second organosilane surface treatment can be applied to one or both members of the construction, either individually before winding, or directly after winding, but preferably after the application of the preferred aminosilane surface treatment. In this way, the aminosilane is used as a pre-treatment. In such a case, it is important that the aminosilane be applied in such a way so as to insure that a substantial fraction of its amine groups are non-protonated. In this way, a durable bond is maintained between the chemisorbed aminosilane and the metal oxide surface, which in turn provides optimum corrosion protection as well as a favorable surface for the chemisorption of the second organosilane. The chemical nature of the second organosilane depends on the desired surface properties of the finished string. In one particularly preferred embodiment, the optional second organosilane is chosen so as to render the surface hydrophobic. Specific examples include perfluorosilanes such as perfluorooctyltriethoxysilane, or alkylsilanes such as octyltriethoxysilane and octadecyltriethoxysilane.

BRIEF DESCRIPTION OF THE DRAWINGS

The present invention should become apparent from the following descriptions in conjunction with the attached drawings, summarized as follows.

DETAILED DESCRIPTION OF PREFERRED EMBODIMENTS

Figure 1:
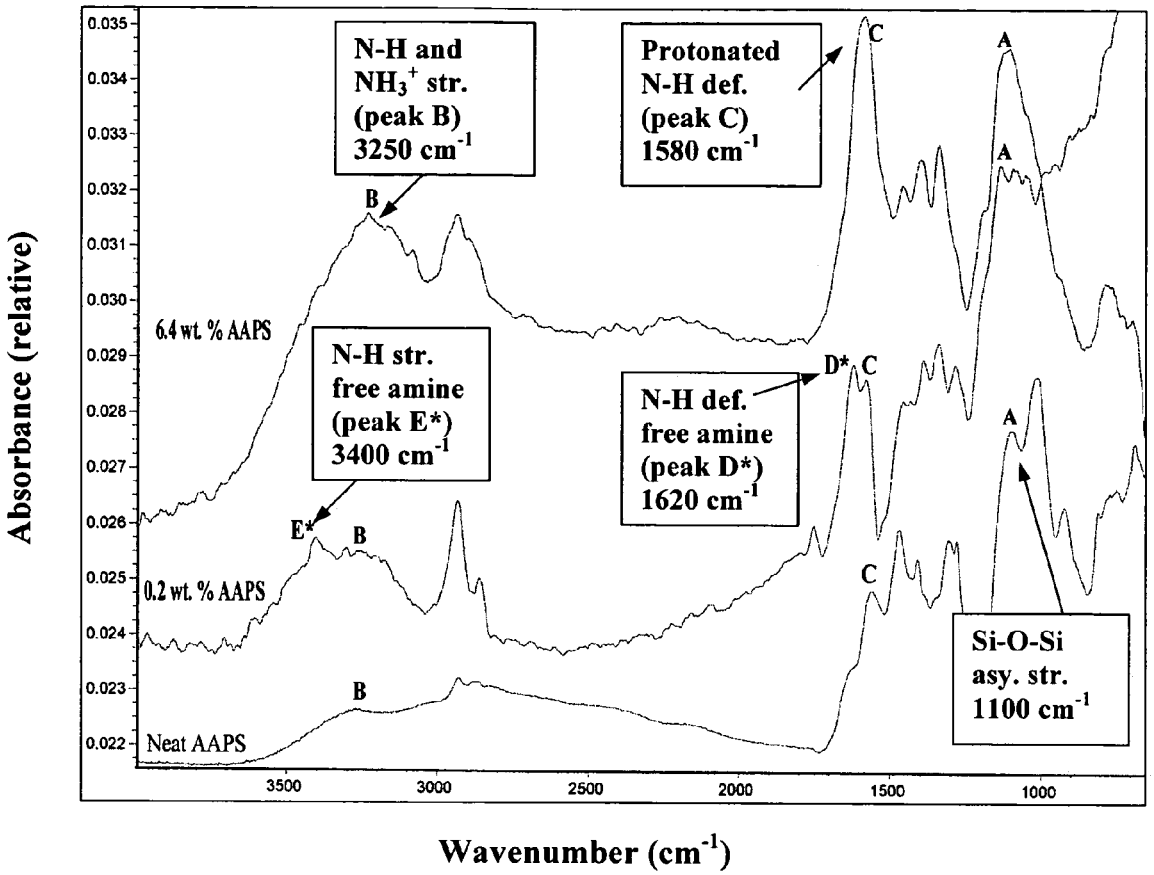
FIG. 1 shows attenuated total reflectance FTIR spectra for a 6.4 wt. % AAPS solution-treated steel-core string, a 0.2 wt. % AAPS solution-treated steel-core string, and a neat AAPS film (from top to bottom; scaled for relative comparison). Assignments include: Si—O—Si asymmetric stetching band near 1100 $cm^{-1}$ (peak A); overlap of N—H stretching and $NH_3^+$ stretching modes near 3250 $cm^{-1}$ (peak B); N—H deformation band for protonated and/or hydrogen bonded primary amine near 1580 $cm^{-1}$ (peak C); N—H deformation mode for free, or associated, primary amine at 1620 $cm^{-1}$ (peak D*); N—H stretching for free, or associated, primary amine at 3400 $cm^{-1}$ (peak E*).

The present invention is an improved string for use on a variety of musical instruments including but not limited to guitar, bass, violin, cello, mandolin, banjo, piano, etc.

A serious problem with many conventional steel-core strings is that they tend to corrode over time; both during storage and in end-use. Even titanium alloy-core strings can exhibit corrosion when the winding wire is comprised of a more anodic material such as brass or phosphor bronze. Corrosion can mechanically weaken the string; and it can eventually lead to contamination and winding slippage, both of which deteriorate sound quality and ultimately lead to what musicians recognize as a "dead" string. Several technologies have been employed in the past to help prevent corrosion (i.e. polymer coatings, ductile metallic coatings, etc.), but these technologies have made use of relatively massive coatings that significantly modulate or dampen the tonal characteristics of the finished string.

It is known that steel cores can readily corrode upon atmospheric exposure, and that corrosion is accelerated during end use. It has also been noted that corrosion can be even more severe if after initial string use, the instrument is allowed to remain idle for long periods of time. Although it has not necessarily been appreciated by others skilled in the art, it can be seen that the steel cores of conventional string constructions are relatively anodic when compared to a saturated calomel reference electrode, and that they are also more anodic than conventional metallic windings. Thus, string corrosion can be accelerated through galvanic action in the presence of moisture and salts of the type that originate from hand contact during instrument use.

It is also known that musical instrument strings comprised of titanium and its alloys can exhibit exceptional corrosion resistance. However, it has been found that even though titanium has exceptional corrosion resistance by itself, this does not guarantee that a wound titanium alloy core string will also have exceptional corrosion resistance. For example, unlike steel core strings, the best corrosion resistance of a titanium core wound string is achieved when its galvanic potential is closely matched to that of the winding. Thus, if the mismatch in galvanic potential is too high, the string's corrosion resistance will be less than optimal, in spite of titanium's excellent reputation as a corrosion resistant metal.

The present invention addresses the aforementioned problems through the use of organosilane surface treatments that provide surprisingly enhanced corrosion protection to both steel-core and titanium alloy-core strings. Furthermore, and quite unexpectedly, the best corrosion protection is unpredictably achieved when the organosilanes are applied at negligibly low levels. This surprising benefit insures that the enhanced corrosion protection is achieved without modulating tonal characteristics.

Although these improvements are observed for both steel-core and titanium alloy-core strings, titanium alloy cores are preferred because they exhibit the most exceptional improvement when they are treated with the preferred surface treatments of the present invention. As an added benefit, the surface treated titanium alloy-core strings of the present invention are less stiff than analogous steel-core strings, and hence they are easier to fret and play.

The strings of the present invention can be manufactured with materials that are known to those skilled in the art, including but not limited to cores of steel, stainless steel, titanium, titanium alloys, nylon, and the like; and windings of various metals, including but not limited to copper alloys such as brass and phosphor bronze. The cores and windings of this invention can be made into strings by methods common to the art, including batch methods, where spiral winding is accomplished through torsional rotation of the core; or through continuous processes where a core is helically wrapped via a rotating assembly. In both cases, the equipment can be modified to allow for continuous or semi-continuous surface treatment during or after winding (over either a portion of, or over the entire string length), together with resistance heating as needed during or after winding, convection heating as needed during or after winding, or plasma treatments during or after winding. Post winding processes can include the aforementioned methods of heating as well as cryogenic treatments as needed, together with batch methods for application of the novel surface treatments described herein. The cores of the strings can be equipped with conventional ball ends either before or after winding, or the finished strings can be equipped with alternative ends such as those which can be swaged, crimped, soldered, or welded into place. The ends of the strings can also be affixed with other appropriate materials, including sheathings and other components as described for example in U.S. Pat. No. 6,348,646 to Parker et al. (2002). In addition, the various end-fittings can be optionally applied either before or after the application of the novel surface treatments described herein.

The organosilane surface treatments of the present invention are applied to one or both members individually before winding, or to the finished wound string. The organosilanes can be applied via processes known to those skilled in the art including but not limited to continuous dipping processes, solution batch processes, roll coating processes, plasma coating processes, ultrasonic bath assisted processes, etc.

The term "organosilane" in the present invention is used to refer to any group of molecules including monomers, hydrolyzed monomers, hydrolyzed dimers, oligomers, and condensation products of a trialkoxysilane having a general formula [1]:

$$(RO)_3Si—R' \quad [1]$$

where R is preferably a propyl, ethyl, methyl, isopropyl, butyl, isobutyl, sec-butyl, t-butyl, or acetyl group, and R' is an organofunctional group where the functionality may include an aminopropyl group, an aminoethylaminopropyl group, an alky group, a vinyl group, a phenyl group, a mercapto group, a styrylamino group, a methacryloxypropyl group, a glycidoxy group, a perfluoro group, a perfluoroether group, an azole group, an imidazole group, and others.

Similarly, a bis-trialkoxysilane having the general formula [2]

$$(RO)_3Si—R'—Si(OR)_3 \quad [2]$$

could also be employed either alone or in combination with a trialkoxysilane, where R is preferably a propyl, ethyl, methyl, isopropyl, butyl, isobutyl, sec-butyl, t-butyl, or acetyl group, and R' is a bridging organofunctional residue which may contain functionality selected from the group consisting of amino groups, alky groups, vinyl groups, phenyl groups, mercapto groups, perfluoro groups, perfluoroether groups, and others.

One preferred organosilane of the present invention is derived from an aminofunctional trialkoxysilane, two types of which include aminopropyltrimethoxysilane, and aminoethylaminopropyltrimethoxysilane (i.e., N-2-aminoethyl-3-aminopropyltrimethoxysilane, commercially available as Z6020 from Dow Corning). These types of compounds are preferred because they have been found to impart a surprising degree of corrosion protection, especially when they are applied and surface adsorbed in such a way so as to insure that a substantial fraction of their amine groups remain non-protonated. Although not wishing to be bound by any one theory, it is believed that the superior corrosion protection is realized when the amine groups are available for surface adsorption onto the metal substrate. This is quite surprising, particularly since organosilanes are conventionally thought to provide their best performance characteristics (at least in adhesion and coupling agent applications) when they are adsorbed directly through their hydrolyzed silanol functional groups (see for example, E. P. Plueddemann, Silane Coupling Agents, Plenum Press, New York, 1982).

The unexpected corrosion protection afforded by these aminosilanes is also surprising in light of the fact that primary amines are typically known to be corrosive to copper and copper alloys. Of equal importance, aminosilanes of the type described in the present invention have been reported to impart no corrosion protection when they are used to treat other types of metal alloys. For example, the corrosion resistance of 2024 and 7075 aluminum alloys was improved with a mercapto-functional silane surface treatment, whereas an aminosilane provided no improvement (see for example, P. R. Underhill and D. L. Duquesnay in *Silanes and Other Coupling Agents*, K. L. Mittal, (Ed.), Vol. 2, pp. 149-158, VSP, Utrecht, The Netherlands, 2000). In another study, corrosion protection of aluminum was only reported to occur from a two-step treatment process, where a metal substrate was first treated with a non-functional silane, and then with a functional silane, so that the functional group of the second silane would not be allowed to deleteriously interact with the metal surface (see for example, V. Subramanian and W. J. van Ooij in *Silanes and Other Coupling Agents*, K. L. Mittal, (Ed.), Vol. 2, pp. 159-174, VSP, Utrecht, The Netherlands, 2000).

By contrast, the present invention demonstrates the unexpected utility of a simple, one-step treatment process that can be used to produce a monolithic surface treatment that protects copper alloy wound strings from corrosion. In fact, it has surprisingly been found to be an advantage, not to curtail the interaction between the organofunctional group and the surface (as has been the objective of others), but to promote it. Further, it has been surprisingly discovered that when the amine groups are substantially non-protonated, excellent corrosion resistance is unexpectedly achieved. Of equal surprise, it has also been found that poor corrosion resistance is the result when the amine groups are substantially protonated.

It is also surprising to note that the achievement of the preferred state of the surface adsorbed organosilane is highly dependent on the process that is used to treat the string.

In preparing the organosilane surface treatment solution, the preferred trialkoxyaminosilane of the present invention can be diluted directly into a solvent carrier such as water, isopropanol, ethanol, methanol, and mixtures thereof. Those skilled in the art will recognize that trialkoxysilanes will react with water to form silanol monomers, dimers and oligomers, and that the distribution of these species will depend on variables like pH, temperature, solvent carriers, concentration, and the availability of water for the hydrolysis reaction (for background on this subject, see for example, E. P. Plueddemann, Silane Coupling Agents, Plenum Press, New York, 1982). Sources of water can include water that is bound to the metal surface, water that is present in solvent carriers, and water that is added for the purpose of prehydrolyzing the trialkoxysilane.

For the purposes of the present invention, the amino-functional trialkoxysilane is preferably prehydrolyzed through the direct addition of water as described in U.S. Pat. No. 5,252,655 to Parker, et al. (1993), where the trialkoxysilane is mixed with ethanol and water at a weight ratio of 50/50/5 for a period of at least 24 hours under ambient conditions before it is diluted for subsequent use. In this way, the trialkoxyaminosilane of the present invention is made to form a prehydrolyzed solution of 47.62% active ingredients comprised of silanol monomers, dimers, and oligomers. This is done as a first step, prior to diluting the active ingredients to form the final constituents of the organosilane surface treatment solution. Although prehydrolysis is not mandatory, those skilled in the art can appreciate that prehydrolysis typically leads to less product variability, and to less process variability (see for example, A. A. Parker, "The effect of silane hydrolysis on aluminum oxide dispersion stability in ceramics processing," J. Adhesion Sci. Technol., Vol. 16, No. 6, pp. 679-701, 2002).

In a subsequent step, the prehydrolyzed solution is diluted in a solvent carrier to yield what will be referred to herein as the "primary treatment solution," which in turn is used to treat the strings of the present invention. Several solvent carriers can be employed for this process, including but not limited to solvents like water, ethanol, isopropanol, methanol, acetone, methylethylketone, and mixtures thereof. One preferred solvent carrier is a 70/30 (v/v) solution of isopropyl alcohol and water. The prehydrolyzed solution is diluted in the solvent carrier to yield a solution comprised of 0.001% to 3.0% of the active ingredients, and more preferably between 0.025% and 0.8% active ingredients, and even more preferably between 0.05% and 0.4% active ingredients.

In determining the appropriate concentration of active ingredients, consideration must be given to several variables including dwell times, the surface areas of the metallic members, and the balance between corrosion resistance and acoustic characteristics. Generally, the total molar surface concentration of the finished treatment should be kept to a minimum so as not to deleteriously affect the stiffness and tonal characteristics of the finished string. However, the molar surface concentration should neither be less than that which is required for surface coverage of the winding wire (since the winding wire is the largest surface area member), nor less than that which is required to achieve the desired level of corrosion enhancement. Typical surface concentrations can range from about $10\times10^{-6}$ moles/m$^2$ for near-monolayer coverage, to about $3\times10^{-3}$ moles/m$^2$.

Although improved corrosion resistance has been observed over a range of surface concentrations, the best corrosion protection for titanium core strings is achieved with strings treated from dilute solutions containing between about 0.05% and 0.4% active ingredients by weight. It has been estimated that these concentrations yield finished surface concentrations ranging from approximately $5\times10^{-5}$ moles/m$^2$ to approximately $8\times10^{-4}$ moles/m$^2$, depending on the surface area of the string components.

For most guitar strings, these coverages equate to mass contributions, which are orders of magnitude less than 1.0% by weight of the finished string, and most typically between 0.0009% and 0.05% by weight of the finished string. Thus, unlike strings of the prior art that employ polymeric coverings and adhesives of relatively substantial mass (as much as 3.5% by weight as taught in U.S. Pat. No. 5,801,319 to Hebestreit, et al. (1998)), the preferred surface treatments of the present invention are exceptionally effective at levels that add negligible mass to a finished string.

It has also been discovered that the most exceptional performance is achieved when the finished surface treatment contains a substantial fraction of non-protonated amines. This condition has been observed to occur only when the surface treatment is applied within the preferred range of dilute solution concentrations. When higher concentrations are employed, the amines become protonated, and corrosion is actually accelerated. In addition, the stiffness and acoustic characteristics are negatively affected by the use of higher solution concentrations. Conversely, when the preferred concentrations are employed, there is little to no change in stiffness, and there is no perceptible change in the acoustic characteristics of the finished string. As an added benefit, strings treated within the preferred range of concentrations exhibit exceptional thermo-mechanical stability, whereas strings treated with more concentrated treatment solutions are thermally and mechanically unstable. While not wishing to be held to any single theory, it is believed that the chemisorption afforded by the preferred non-protonated "free" amines provides a strong durable bond that resists both hydrolysis and dimensional change. By contrast, it is believed that the surface treatments comprising a substantial fraction of protonated amines are weakly bonded through ionic forces, and hence are susceptible to dissolution, and to fracture from the stresses of heating and cooling.

It is to be appreciated that although the preferred surface treatment is one where the amines are substantially non-protonated, a population of states could exist, whereby certain non-protonated amines could be free, while others could be chelated to metal ions that are either on or near the surfaces of the treated metals. In addition, it is to be appreciated that the non-protonated amines may coexist with protonated amines. However, the best bonding and hence the best corrosion protection is expected to occur as the fraction of non-protonated amines increases to a point where a substantial fraction are non-protonated. For the purposes of this invention, a "substantial fraction" can be taken to mean at least half of the population of amine groups in the finished surface treatment.

Prior to treatment, the finished strings or individual components are preferably cleaned in the presence of optional emulsifiers under either basic, acidic, or neutral conditions; and through the use of one or more cleaning methods including solvent wash methods, ultrasonic cleaning methods, water immersion methods, or other methods known to those skilled in the art. The strings or string components can also be optionally pretreated with other compounds including but not limited to azoles, organophosphates, etc. In addition, these optional compounds can also be added to the preferred organosilane treatment solutions of the present invention.

After the components are cleaned, the preferred primary treatment solution is prepared as described above, and is then used within approximately 48 hours of its preparation, and most preferably within 24 hours. It is important that the primary treatment solutions be used within a specified period of time, otherwise the active ingredients may precipitate out of solution. Next, the finished string, or the individual components prior to winding, are surface treated through the use of any combination of processes known to those skilled in the art, including continuous or batch treatment processes. In one preferred treatment process, a wound string is immersed in (or for the case of a continuous process, passed through) an ambient treatment solution bath for a period of between 0.01 minutes and 10 minutes, and more preferably for a period of between 0.1 and 5 minutes, and most preferably for a period of between 0.5 and 2 minutes. Upon removal from the bath, the string is dried either under ambient conditions with the optional assistance of forced air, or more preferably with hot blown air, where the dwell time and temperature are sufficient so as to evaporate the solvent carrier. Typical conditions can include hot-air temperatures of between 50° C. and 200° C. for dwell times ranging between 10 seconds at lower temperatures to less than 1 second at higher temperatures. In the next step, the strings can be optionally baked for the purpose of driving off excess solvent carrier, and to complete the hydrolysis and condensation reactions. The optimum bake temperature is between 50° C. and 110° C., and most preferably between 65° C. and 100° C. Excessive temperatures or excessive exposure times at elevated temperatures should be avoided since they can lead to the unwanted degradation of the primary amine groups (see for example, Parker, A. A. et al., "Characterization of polyaminosiloxane surface chemistry on aluminum oxide," J. Adhesion, Vol. 73, pp. 197-214, 2000). Although different bake profiles could be employed, one example of a profile that has been found to be suitable for the purposes of this invention include an isothermal bake cycle time of approximately 45 minutes to 1 hour at a temperature of 96° C.

As another embodiment of the present invention, an optional secondary organosilane surface treatment can be sequentially applied after the application of the primary organosilane surface treatment for the purpose of creating a finished string comprising two monolithic surface treatment layers, wherein the preferred primary organosilane surface treatment functions as a pre-treatment for the optional secondary organosilane. Although the primary organosilane surface treatment of the present invention provides an excellent finished surface on its own, a secondary organosilane treatment can be chosen for its ability to impart optional characteristics to the finished string surface. In such a case, the primary organosilane surface treatment of the present invention provides an excellent surface for chemisorption of the secondary treatment.

For example, if a higher degree of hydrophobicity is desired, then the preferred optional secondary organosilane surface treatments may include derivatives of trialkoxysilanes, and derivatives of bis-trialkoxysilanes; including alkyltriethoxysilanes, perfluoroether derivatives of trialkoxysilanes, perfluoroether derivatives of bistrialkoxysilanes, and perfluorotrialkoxysilanes. Specific examples of alkyltrialkoxysilanes include n-octyltriethoxysilane, and octadecyltriethoxysilane. A specific example of a perfluorotrialkoxysilane includes perfluorooctyltriethoxysilane, and a specific example of a bistrialkoxysilane includes 1,2-bis-(triethoxysilyl)ethane. A specific example of an acceptable perfluoroether derivative of a trialkoxysilane includes a perfluoroether ester derivative of aminopropyltriethoxysilane (commercially available as Fluorolink™ S10 from Solvay/Ausimont).

If an optional secondary organosilane treatment is to be employed, then the aforementioned baking step of the primary organosilane treatment is preferably postponed until the secondary treatment is complete. The secondary treatment can be applied immediately after the application of the primary treatment, but it is preferable to first dry the primary treatment with the assistance of hot air as described above, and then to sequentially apply the optional secondary treatment in a second application process. The solution deposition process for application of the optional secondary treatment can be completely analogous to that which is used to apply the primary organosilane treatment. Once the secondary treatment is applied, the treated string (now comprising two or more monolithic organosilane layers) is optionally baked as described above. Although not wishing to be bound by any one theory, it is believed that when a substantial fraction of the non-protonated amine groups are surface adsorbed, the primary treatment provides the string surface with silanol groups that in turn facilitate the bonding and chemisorption of the hydrolyzed silanol groups of the optional secondary organosilane surface treatment. In this way, the optional secondary treatment can form a durable bond with the pre-treated surface, particularly when the two monolithic layers are baked in tandem onto the finished string. In addition, the optional secondary treatment can impart other desirable properties to the finished string, including hydrophobicity, and enhanced corrosion resistance.

The optional secondary organosilane treatment solution is prepared using procedures similar to those used for the preferred primary treatment. The optional silane is first prehydrolyzed under acidic or basic conditions (either as a concentrate or in dilute solution) using procedures known to those skilled in the art, and then is diluted as needed in a solvent carrier, where the preferred carrier is selected from the same group used in the preparation of the primary organosilane surface treatment. The preferred concentration for the secondary organosilane surface treatment solution is preferably between 0.001% and 0.5% by weight active ingredients, more preferably between 0.01% and 0.3%, and most preferably between 0.05% and 0.2%. The optional secondary treatment is then applied to the finished string (or to its components prior to winding) via methods described above. The string is then air-dried as described above to remove the solvent carrier, and it is then optionally subjected to the aforementioned bake cycle.

In another optional embodiment, a secondary organosilane can be mixed together with the preferred organosilane surface treatment to form an organosilane solution mixture. In this way, the optional second organosilane can be applied to the string components or to the finished string in a one-step solution treatment process together with the preferred aminofunctional organosilane.

The benefits of the present invention are illustrated in the following examples. The first example was performed for the purpose of comparison.

EXAMPLE 1 (COMPARATIVE)

This example demonstrates the relative corrosion resistance of musical instrument strings that have been treated with a known corrosion inhibitor (for purposes of comparison).

The musical instrument strings for this example included two types of commercially available constructions that were designed for acoustic guitar: phosphor bronze wound titanium-core strings from a set of Rohrbacher Low-tension Titanium Acoustic Guitar Strings™ (available from Rohrbacher Technologies, Bordentown, N.J.); and phosphor bronze wound steel-core strings from a set of John Pearse™ medium-tension acoustic guitar strings. All of the strings were used as received.

In each corrosion experiment, 30 ml glass vials with lids were filled with 5 g of a saturated aqueous NaCl stock solution (prepared with deionized water, and reagent grade NaCl from Aldrich Chemical Company). The string samples were cut into 3.17 cm strips, and were placed into the glass vials with a portion of each submerged below the water line, and with a portion of each above the air/water interface. Two visual criteria were used to qualitatively rank corrosion: the degree of winding discoloration above the water line, and the degree of turbidity below the water line.

In the first series of surface treatment experiments, the corrosion resistance of phosphor bronze wound strings was determined as a function of the relative weight of benzotriazole (BTA, Aldrich Chemical Company). The strings for this comparison included a John Pearse™ medium-tension "E" string (phosphor bronze wound steel core); and a Rohrbacher Technologies low-tension "E" string (C521 phosphor bronze wound Ti alloy core). Both types of strings were cut into 3.17 cm strips, and were then surface treated by dipping into solutions of benzotriazole (30, 300, 600, and 1000 ppm concentrations by weight) dissolved in a 95/5 weight percent mixture of denatured ethanol (denatured reagent grade from Aldrich Chemical Company) and deionized water. Each wound section was separately dipped into a solution for one minute, and then was removed to air dry for 15 hours prior to corrosion testing. Samples of each string were also tested as received (with no treatment), and after solvent washing with ethanol. The samples were qualitatively evaluated as described above, and were ranked (from low to high) according to the relative degree of turbidity after 30 hours of exposure. Steel-core trends were visible within approximately 4 hours (as seen from turbidity below the water line and discoloration above the water line), whereas titanium-core strings showed no change prior to 11 hours (turbidity below the water line and discoloration above the water line began to develop by 14 hours).

This test successfully demonstrates the relative corrosion differences between steel and titanium alloy core strings. It also successfully demonstrates the anticipated effects of concentration for an established corrosion inhibitor. Table 1-1 shows the effect of BTA solution treatment concentration (parts per million, ppm by weight) on the relative degree of corrosion of phosphor bronze wound steel-core and titanium-core strings after 30 hours of exposure to concentrated salt solutions (the combined relative rankings are based on visual turbidity, where 1=least corrosion, and 11=highest degree of corrosion).

TABLE 1-1

| BTA Solution Concentration (ppm) | Relative Degree of Corrosion: Phosphor Bronze Wound Steel-Core Strings | Relative Degree of Corrosion: Phosphor Bronze Wound Titanium-Core Strings |
|---|---|---|
| 0, tested as received | 11 | 5 |
| 0, ethanol washed | 10 | 4 |
| 30 | 9 | 3 |
| 300 | 8 | 2 |
| 600 | 7 | 1 |
| 1000 | 6 | 1 |

Although the overall degree of corrosion among the titanium-core samples was significantly less than that of the steel-core samples, the protection afforded by BTA was observed to increase monotonically in both sets. The initial differences were apparent above the water line (from partial oxidation and discoloration of the phosphor bronze winding), and below the water line (from the turbidity due to the build-up of corrosion byproducts and precipitates). After 3 days, the differences in steel-core samples were no longer discernible (due to extreme corrosion), whereas the differences among titanium-core samples remained visible for more than 1 week.

Previous studies have shown that BTA provides protection against cathodically induced oxidation of copper alloy surfaces (see for example, J. B. Cotton and I. R. Scholes, *Brit. Corrosion J,* 2, 1-5, 1967). This is consistent with the finding that BTA lessens the oxidation of phosphor bronze when it is wound around a more cathodic titanium alloy core. Similarly, BTA also provides anodic protection in cases where copper alloys are in contact with more anodic metals. This is consistent with the finding that BTA lessens the oxidation of the more anodic steel core when it is wound with phosphor bronze.

These data verify that the test as used in this example is useful for discerning relative differences in the corrosion behavior of surface treated musical instrument strings. Hence the test can be used to evaluate other compounds for their potential corrosion inhibition characteristics.

EXAMPLE 2

Using the test methods of EXAMPLE 1, this example demonstrates the relative corrosion resistance of musical instrument strings that have been surface treated with the preferred primary surface treatment of the present invention.

In this series of surface treatment experiments, phosphor bronze wound strings were treated to determine the effect of an organosilane surface treatment on the corrosion resistance of both steel-core and Ti alloy-core strings. The strings for this comparison included a DR-Rare-Bronze™ light-tension "A" string (C521 phosphor bronze wound steel core); and a Rohrbacher Technologies Low-tension "A" string (C521 phosphor bronze wound Ti alloy core). The composition of C521 phosphor bronze is given by ASTM B159 as Pb (0.05% max), Fe (0.10% max), Sn (7.0-9.0%), Zn (0.20% max), P (0.03-0.35%), and Cu (remainder). Both types of strings were cut into 3.17 cm strips as described in EXAMPLE 1, and were then surface treated by dipping into solutions of pre-hydrolyzed N-2-aminoethyl-3-aminopropyltrimethoxysilane (AAPS), otherwise known as Z6020 from Dow Corning.

The AAPS was prehydrolyzed by mixing 50 parts silane with 50 parts ethanol and 5 parts distilled water at 25° C. After 24 hours, the prehydrolyzed concentrate was diluted into 70/30 (v/v) isopropanol/water (Aldrich Chemical Company) to yield solutions with concentrations of 0.05, 0.1, 0.2, 0.4, 0.8, 1.6, 3.2, and 6.4% active silane by weight. Each wound section was separately dipped into a solution for one minute, and then was flash dried with a hot-air gun (at a temperature of approximately 150° C.) with a 2 second dwell time. The samples were then allowed to equilibrate under atmospheric conditions for 48 hours prior to corrosion testing.

Qualitative rankings were established based on the relative degrees of visual corrosion (as judged by turbidity), where the titanium-core sample with the lowest degree of corrosion (after 21 days of exposure) was ranked as 1, and the remainder of the group was ranked in sequence from low to high according to increasing degrees of turbidity. The steel-core samples (after 24 hours of exposure) were then ranked in comparison to this baseline, where the visual turbidity of the untreated steel-core control (after 24 hours of exposure) was noted to be equivalent in rank to the untreated titanium-core control sample (after 21 days of exposure). The other steel-core samples were then ranked in relative comparison to one another (from low to high) with respect to the titanium-core baseline.

The results of the present study show that AAPS improves the corrosion resistance of both types of phosphor bronze wound metallic strings. Table 2-1 provides a qualitative visual ranking of the relative degree of corrosion (as judged by the turbidity of NaCl solutions) for both steel-core and titanium-core strings as a function of the organosilane solution concentration (1=least corrosion, 8=highest degree of corrosion).

TABLE 2-1

| AAPS Solution Concentration (% active ingredients by weight) | Relative Degree of Corrosion: Phosphor Bronze Wound Steel-Core Strings after 24 hours | Relative Degree of Corrosion: Phosphor Bronze Wound Titanium-Core Strings after 21 days |
|---|---|---|
| 0, tested as received | 6 | 6 |
| 0.05 | 5 | 2 |

TABLE 2-1-continued

| AAPS Solution Concentration (% active ingredients by weight) | Relative Degree of Corrosion: Phosphor Bronze Wound Steel-Core Strings after 24 hours | Relative Degree of Corrosion: Phosphor Bronze Wound Titanium-Core Strings after 21 days |
|---|---|---|
| 0.1 | 4 | 3 |
| 0.2 | 3 | 1 |
| 0.4 | 3 | 5 |
| 0.8 | 3 | 4 |
| 1.6 | 4 | 4 |
| 3.2 | 7 | 7 |
| 6.4 | 8 | 8 |

For the case of steel-core strings, the NaCl solutions were orange in color (due to the formation of $Fe_2O_3$ precipitates), whereas the solutions for the titanium-core strings were blue in color (due to the formation of copper (II) precipitates). Although the trends in both sets were similar, the differences among the steel-core strings were discernible within 24 hours of exposure, whereas the differences among titanium-core samples could not be discerned for several days.

These results show that when compared to untreated strings, the corrosion resistance is unexpectedly improved with solution treatment concentrations ranging from between 0 and 0.05% AAPS by weight at the lower limit, to between 1.6% and 3.2% AAPS by weight at the upper limit. Surprisingly, the relative degree of corrosion is accelerated at higher concentrations. The degree of corrosion protection increases with increasing solution-concentration-up to some-optimum concentration, where the optimum improvement occurs at between about 0.05% and 0.4% AAPS by weight for the titanium-core strings of this example, and between about 0.1% and 1.6% for the steel-core strings of this example. Beyond these levels, the degree of corrosion protection lessens. Thus, up to a certain threshold level of surface treatment, AAPS appears to stabilize the surface of phosphor bronze against both cathodic and anodic reactions. Beyond this threshold, little to no visible corrosion protection is provided, and corrosion is actually accelerated.

Given that AAPS improves the corrosion resistance of phosphor bronze wound strings, it appears that AAPS (like BTA) has the unexpected and surprising ability to stabilize the metal oxide surface layer. Although not wishing to be held to any single theory, given that BTA provides similar protection, and given that Cu and its oxides are known to bind with BTA to form polymeric complexes, it follows that under certain conditions, Cu may also bind with the amine groups of AAPS to form a protective surface layer.

EXAMPLE 3

A method was developed to estimate the level of organosilane deposition, so that the mass of the surface treatment could be expressed as an estimated percentage of the total mass for any treated string. The organosilane treatment solution for this example was comprised of 5.143% active ingredients, including 4.290% by weight of prehydrolyzed Z6020, and 0.853% by weight of a perfluoroether functionalized trialkoxysilane, commercially known as Fluorolink™ S-10 from Solvay. The solution was prepared by first prehydrolyzing the Z6020 using the methods of EXAMPLE 2. After 24 hours, the prehydrolyzed Z6020 was added to 70/30 (v/v) IPA and water. Next, the S-10 was added to yield the final organosilane solution. This solution was then aged for a period of 24 hours under ambient conditions prior to use.

The treatment solution was applied to three separate 6 in. segments cut from a 0.046" nickel plated steel wound steel-core string (removed from a set of Tite-Fit™ electric guitar strings, manufactured by DR Strings of Emerson, N.J.). The string segments were dipped into the treatment solution for a period of 1 minute, and were subsequently dried in a gravity oven set at 65° C. for a period of 2 hours. Gravimetric measurements were made (to four decimal places) on the dry segments "as-received," on the wet segments immediately after treating, and on the finished segments after drying. These measurements were used to determine 1) the solution weight after treatment (taken as the difference between the wet-weight and the as-received dry weight), and 2) the weight of the organosilane surface treatment after drying (taken as the difference between the dry weight of the treated string and the as-received dry weight). In addition, the solution weights were used to calculate the mass of dry treatment for comparison to measured values. The data are provided in Table 3-1.

TABLE 3-1

| String | Mass of as-received string (grams per 6-inch length) | Mass of of solution deposition (grams per 6-inch length) | Measured mass of of dry surface treatment (grams per 6-inch length) | Calculated mass of of dry surface treatment (grams per 6-inch length) |
|---|---|---|---|---|
| 0.046" DR Tite-Fit ™ | 1.0123 | $2.20 \times 10^{-2}$ | $2.0 \times 10^{-3}$ | $1.1 \times 10^{-3}$ |
| 0.046" DR Tite-Fit ™ | 1.0223 | $3.89 \times 10^{-2}$ | $2.7 \times 10^{-3}$ | $2.0 \times 10^{-3}$ |
| 0.046" DR Tite-Fit ™ | 1.0256 | $2.75 \times 10^{-2}$ | $1.5 \times 10^{-3}$ | $1.4 \times 10^{-3}$ |
| AVERAGE | 1.020 +/− 0.007 | $2.94 \times 10^{-2}$ +/− $0.86 \times 10^{-2}$ | $2.0 \times 10^{-3}$ +/− $0.6 \times 10^{-3}$ | $1.5 \times 10^{-3}$ +/− $0.5 \times 10^{-3}$ |

The calculated and measured dry treatment weights are similar (within error), and show that even when a relatively concentrated surface treatment solution is used (5.143% active ingredients in this case), the resultant mass of the surface treatment is extremely low. In fact, the average mass of the surface treatment in this example constitutes approximately 0.15% to 0.20% of the mass of the treated string.

EXAMPLE 4

This example demonstrates the relative degree of corrosion protection that is imparted by a monolithic organosilane surface treatment of the type used in EXAMPLE 3. The organosilane treatment solution for this example was comprised of ~1.1% active ingredients, including 1.0% by weight of prehydrolyzed Z6020, and 0.1% by weight of Fluorolink™ S-10. The solution was prepared by first prehydrolyzing the Z6020 using the methods of EXAMPLE 2. After 24 hours, the prehydrolyzed Z6020 was diluted in distilled water, and then the S-10 was added to yield the final aqueous organosilane solution. The solution was then aged under ambient conditions for a period of 24 hours prior to use.

A 0.042" diameter phosphor bronze wound steel-core "A" string was removed from a set of DR-Rare-Bronze™ light-tension strings, and was surface treated with the 1.1% organosilane solution (using the procedures of EXAMPLE 2). The relative corrosion resistance of the treated string was then compared to that of an otherwise identical untreated string (using the methods of EXAMPLE 1).

Within the first thirty minutes of exposure to the concentrated brine, the untreated string showed evidence of discoloration above the water line, whereas the treated string showed no change. Within four hours, the untreated string showed evidence of steel corrosion (orange turbidity below the water line) in addition to extreme discoloration above the water line. On the other hand, the treated string showed no evidence of steel corrosion, and only a slight degree of discoloration above the water line.

EXAMPLE 5

Using the organosilane solutions and the application procedures of EXAMPLE 2, phosphor bronze wound steel-core "A" strings (0.042" diameter; removed from sets of DR-Rare-Bronze™ light-tension strings) were individually and separately treated with 0.2% and 6.4% solutions for the purpose of comparing tonal qualities, surface chemical compositions, and dynamic mechanical properties. The string that was treated from the 0.2% solution represented a case where improved corrosion resistance was surprisingly achieved, whereas the string that was treated from the 6.4% solution represented a case where the corrosion resistance was worse than that of an "as-received" string.

The treated strings were strung on a Seagull "Artist Series" acoustic guitar together with an "as-received" string for the purpose of simultaneously evaluating and comparing the tonal qualities. The strings were placed in the "Bass-E," "A," and "D" positions, and were tuned to the pitch of "A" at 110 Hz. The strings were individually plucked and were qualitatively compared for their brightness, and for their relative dampening characteristics. The "as-received" string and the 0.2% solution-treated string produced surprisingly similar sound characteristics. Both strings possessed what musicians commonly recognize as the initial brightness of new strings. In addition, after being plucked, both strings were observed to resonate for equivalent periods of time with no perceptible differences in damping characteristics. On the other hand, the 6.4% solution-treated string possessed a "muffled" tone, and its resonance period was significantly reduced (i.e., dampened) when compared to the other two strings. Thus, there exists not only a preferred range of concentrations for achieving improved corrosion resistance, but also a maximum surface concentration, beyond which the tonal characteristics become perceptibly affected.

Based on the mass per unit length of the "as-received" "A" string (estimated to be approximately 0.16 grams per inch), and based on the dry mass of the surface treatments (estimated to be $3.13 \times 10^{4}$ grams per inch and $9.80 \times 10^{-6}$ grams per inch for the 6.4% solution-treated and 0.2% solution-treated strings respectively), the mass percentage of surface treatment was estimated to be 0.19% by total mass for the 6.4% solution-treated string, and 0.006% for the 0.2% solution-treated string. It is surprising to note that the tonal properties are affected at a surface treatment mass contribution of only 0.19%, especially since this mass contribution is significantly less than the mass contribution of protective covers that have been employed by others in the prior art. For example, the polymeric coverings and adhesives as disclosed in U.S. Pat. No. 5,801,319 to Hebestreit, et al. (1998) contribute to 3.5% of the entire string mass (based on the data provided in examples 8 and 11 of that patent). Thus, unlike the polymeric coverings of the prior art, the surface treatments of the present invention are optimally suited for use at extremely low levels (i.e., as surface treatments), where the mass contribution is negligible.

Surprisingly, as shown in EXAMPLE 2, the surface treatments of the present invention also provide their greatest corrosion protection at low concentrations. In order to gain more insight into this unexpected phenomenon, attenuated total reflectance FTIR analyses were performed on two DR-Rare-Bronze™ light-tension "A" strings treated with 0.2 and 6.4 wt. % AAPS solutions, respectively. In addition, an FTIR spectrum was also collected for a neat AAPS film that was cast onto a Teflon coated pan under equivalent conditions.

Spectra were collected with a Magna-IR™ 560 instrument from Thermo-Nicolet that was equipped with a DTGS KBr detector, and a MIRacle™ ZnSe single reflection HATR accessory from Pike Technologies. The HATR accessory was equipped with a clamp to maintain adequate contact between the sample and the ZnSe crystal. A total of 64 scans were signal averaged at a resolution of 4 $cm^{-1}$.

FIG. 1 shows attenuated total reflectance FTIR spectra (scaled for relative comparison) for the 6.4 wt. % AAPS treated string, the 0.2 wt. % AAPS treated string, and a neat AAPS film (from top to bottom). The presence of an organosilane condensation product is confirmed by the appearance of a strong Si—O—Si asymmetric stretching band near 1100 $cm^{-1}$ (peak A) in all three spectra [references pertaining to this peak assignment include E. P. Plueddemann, *Silane Coupling Agents*, Plenum Press, New York (1982); and N. B. Colthup, L. H. Daly and S. E. Wiberley, *Introduction to Infrared and Raman Spectroscopy*, Third Edition, Academic Press, New York (1990)]. In addition, both the neat film and the 6.4% treated string show many of the spectral characteristics that have been previously associated with the presence of protonated and strongly hydrogen bonded aminosilanes. These characteristics include an absorption at approximately 3250 $cm^{-1}$ (peak B) which is consistent with the hydrogen bonded N—H stretching band and the $NH_3^+$ stretching mode [a reference pertaining to this peak assignment includes N. B. Colthup, L. H. Daly and S. E. Wiberley, *Introduction to Infrared and Raman Spectroscopy*, Third Edition, Academic Press, New York (1990)], a broad set of weak absorptions between 2100 $cm^{-1}$ and 2800 $cm^{-1}$ which is consistent with a previous assignment to combination bands for amine bicarbonate salts [references pertaining to this peak assignment include J. R. Culler, S. Naviroj, H. Ishida and J. L. Koenig, *J. Colloid Interface Sci.,* 96, 69 (1983); and J. R. Culler, H. Ishida and J. L. Koenig, *Polym. Composites,* 7, 231 (1986)], and an absorption at approximately 1580 $cm^{-1}$(peak C) that is consistent with previous assignments to the N—H deformation band for protonated and/or hydrogen bonded primary amines [references pertaining to this peak assignment include N. B. Colthup, L. H. Daly and S. E. Wiberley, *Introduction to Infrared and Raman Spectroscopy*, Third Edition, Academic Press, New York (1990); J. R. Culler, S. Naviroj, H. Ishida and J. L. Koenig, *J. Colloid Interface Sci.,* 96, 69 (1983); and J. R. Culler, H. Ishida and J. L. Koenig, *Polym. Composites,* 7, 231 (1986)].

The spectrum for the 0.2% AAPS treated string appears unexpectedly different from the other two. Although it shares some of the same spectral characteristics, two additional absorption bands appear at 3400 $cm^{-1}$(peak E), and at 1620 $cm^{-1}$(peak D). These bands are consistent with previous assignments to the N—H stretching, and N—H deformation modes, respectively, for either free, or associated, primary amines [references pertaining to this peak assignment include E. P. Plueddemann, *Silane Coupling Agents*, Plenum Press, New York (1982); N. B. Colthup, L. H. Daly and S. E. Wiberley, *Introduction to Infrared and Raman Spectroscopy*, Third Edition, Academic Press, New York (1990); J. R. Culler, S. Naviroj, H. Ishida and J. L. Koenig, *J. Colloid Interface Sci.,* 96, 69 (1983); and J. R. Culler, H. Ishida and J. L. Koenig, *Polym. Composites,* 7, 231 (1986)].

The appearance of the higher frequency bands on the surface of the 0.2% treated string (at 3400 $cm^{-1}$ and 1620 $cm^{-1}$), and the simultaneous diminution of these bands on the 6.4% AAPS treated string, indicate that the chemical state of the amine plays a major role in corrosion inhibition. Specifically, the treatment with the highest fraction of protonated amines provides no corrosion protection, whereas the treatment with the higher fraction of either free or associated amines provides greatly improved corrosion protection. Thus, it appears that AAPS provides improved corrosion protection when its amine moieties are free either to associate with the metal oxide surface, or to chelate with metal ions that may otherwise dissociate and migrate from the surface during the corrosion process. Conversely, when the amine moieties are predominantly protonated, corrosion protection is not observed. In addition, these data also show that the relative fraction of protonated amines depends on the solution concentration that is employed during the treatment process. Specifically, deposition from a dilute solution leads to high fractions of free or associated amines, whereas deposition from a concentrated solution leads to high fractions of protonated amines.

Dynamic Mechanical Analysis (DMA) was also performed on DR-Rare Bronze™ light-tension "A" strings (treated and "as-received") for the purpose of determining the effect of the AAPS organosilane surface treatment on resonant characteristics, and on thermo-mechanical stability. The analyses were performed on a TA Instruments model 983 DMA equipped with vertical clamps. The data were collected in resonant mode using a sample length of 10 mm, and an oscillation amplitude of 0.8 mm. Samples were heated from ambient to 150° C. at a heating rate of 5° C. per minute. The samples were then cooled to room temperature and were rerun under the same conditions.

Figure 2:
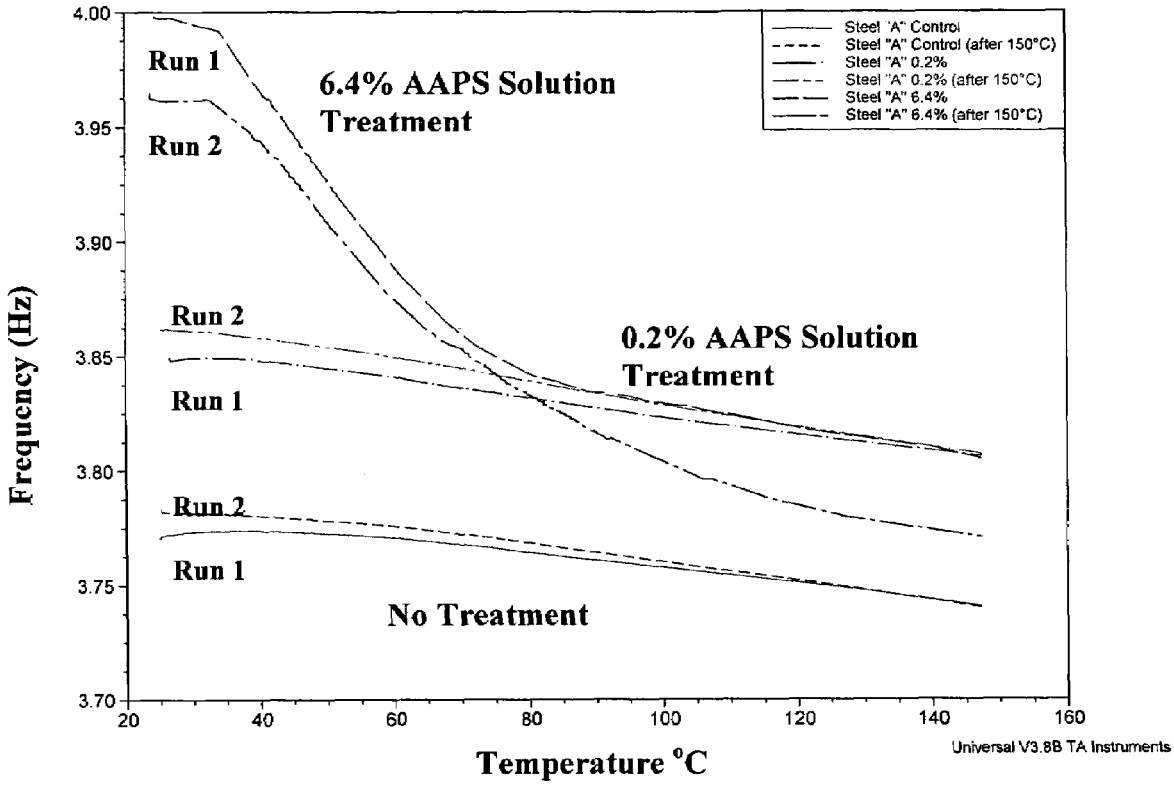
FIG. 2 shows resonant mode DMA spectra (frequency vs. temperature) for a 6.4 wt. % AAPS solution-treated steel-core string, a 0.2 wt. % AAPS solution-treated steel-core string, and an untreated steel-core string. Initial runs and reruns of each sample are simultaneously displayed.

The DMA results indicate that the mechanical properties of the strings are strongly influenced by the presence of the AAPS surface treatment. FIG. 2 shows that the treated strings resonate at higher frequencies, and that the relative string stiffness (resonant frequency) increases with the mass of the treatment. In addition, the 6.4% solution-treated string undergoes a steep mechanical transition between approximately 35° C. and 80° C. It is relevant to note that the "as-received" and 0.2% solution-treated strings do not undergo this transition. In fact, the dynamic mechanical spectra of the "as-received" and 0.2% solution-treated strings are essentially mirror images of one another (during both the initial runs and during the reruns). The only difference between the two strings is a translation along the frequency axis, which manifests itself uniformly across the entire temperature range. Thus, the organosilane surface treatment of the 0.2% solution-treated string is both surprisingly strong and thermally stable. It resists the stresses of expansion and contraction (associated with the heating and cooling of the metallic components), and it also resists degradation during heating and reheating. The exceptional thermo-mechanical stability of the 0.2% solution-treated string shows that the predominantly non-protonated bonding environment of the aminosilane surface treatment leads to a strongly bonded, and surprisingly stable treatment.

Conversely, the 6.4% solution-treated string exhibits completely different thermo- mechanical behavior (both during its initial run and during its rerun). Unlike the "as-received" and 0.2% solution-treated strings, which exhibit slightly higher resonant frequencies during their respective reruns, the 6.4% solution-treated string exhibits a lower resonant frequency during its rerun. Furthermore, as the temperature is increased during the rerun, the resonant frequency of the 6.4% solution-treated string decreases to a level below that of the 0.2% solution-treated string. Thus, unlike the thermally stable 0.2% solution-treated string, the 6.4% solution-treated string, which contains a high fraction of protonated amines, is surprisingly unstable (both mechanically, and thermally).

Collectively, these data show that the exceptional combination of thermo-mechanical stability, corrosion resistance, and tonal characteristics, are simultaneously achieved only at low surface treatment levels, where a substantial fraction of the amine groups exist within a non-protonated bonding environment. Although not wishing to be held to any single theory, it is believed that these exceptional properties arise when the non-protonated amines are available to form stable bonds with the metal surfaces. Conversely, when a substantial fraction of the amines are protonated (as occurs at higher surface treatment concentrations), the resulting surface treatment exhibits unexpectedly inferior properties.

EXAMPLE 6

The data of EXAMPLE 3 were used to estimate the molar surface coverage as a function of the organosilane solution concentration for the phosphor bronze wound "A" strings of EXAMPLE 2. In addition, calculations were performed for the remaining wound strings in the DR-Rare Bronze™ light-tension set (Table 6-1), for the remaining wound strings in the Rohrbacher Low-tension Titanium Acoustic Guitar Strings™ set (Table 6-2), and for the wound strings in a set of Rohrbacher Medium Tension Phosphor Bronze wound Titanium Acoustic Guitar Strings™ (Table 6-3).

The surface area per lineal inch for any string can be calculated based on measurements of the cylindrical core-wire diameter, the cylindrical winding-wire diameter, the alloy densities, and the mass contribution per lineal inch from each component. Using the average solution-deposition value from EXAMPLE 3 ($4.9\times10^{-3}$ g/inch), the mass of surface treatment deposition can be estimated from any given solution concentration. In turn, with knowledge of the molecular weight of the surface treatment (178 g/mole for Z6020), the molar surface coverage can be calculated (i.e., moles/$m^2$). Knowledge of a molar surface coverage can in turn be used to calculate the appropriate solution concentration that is required to achieve equivalent molar coverage for a different string (i.e., for a string having a different surface area per lineal inch). Alternatively, the sum total mass of surface treatment can be expressed as a percentage of the total mass of the treated string as exemplified by the calculations presented in Table 6-4.

Table 6-1 shows molar surface coverage (moles/$m^2$) calculated as a function of solution concentration of Z6020 organosilane surface treatment as applied to a set of DR-Rare Bronze™ light-tension wound strings. The theoretical dry-mass of the surface treatment is based on an estimated solution-deposition mass of $4.9\times10^{-3}$ g/inch (from EXAMPLE 3). The surface areas of strings ($m^2$ per inch) are calculated based on an assumption of cylindrical geometries for the component wires.

TABLE 6-1

| Organosilane solution concentration (% active ingredients by weight) | Theoretical dry-mass of surface treatment (g/inch) | DR-Rare Bronze ™ light "E" (d = 0.054" $2.68\times10^{-4}$ $m^2$ per inch); moles/$m^2$ | DR-Rare Bronze ™ light "A" (d = 0.042" $2.11\times10^{-4}$ $m^2$ per inch); moles/$m^2$ | DR-Rare Bronze ™ light "D" (d = 0.032" $1.75\times10^{-4}$ $m^2$ per inch); moles/$m^2$ | DR-Rare Bronze ™ light "G" (d = 0.024" $1.42\times10^{-4}$ $m^2$ per inch); moles/$m^2$ |
|---|---|---|---|---|---|
| 0.05 | $2.45\times10^{-6}$ | $5.13\times10^{-5}$ | $6.52\times10^{-5}$ | $7.86\times10^{-5}$ | $9.69\times10^{-6}$ |
| 0.1 | $4.90\times10^{-6}$ | $1.02\times10^{-4}$ | $1.30\times10^{-4}$ | $1.57\times10^{-4}$ | $1.93\times10^{-4}$ |
| 0.2 | $9.80\times10^{-6}$ | $2.05\times10^{-4}$ | $2.60\times10^{-4}$ | $3.14\times10^{-4}$ | $3.87\times10^{-4}$ |
| 0.4 | $1.96\times10^{-5}$ | $4.10\times10^{-4}$ | $5.21\times10^{-4}$ | $6.29\times10^{-4}$ | $7.75\times10^{-4}$ |
| 0.8 | $3.92\times10^{-5}$ | $8.21\times10^{-4}$ | $1.04\times10^{-3}$ | $1.25\times10^{-3}$ | $1.55\times10^{-3}$ |
| 1.6 | $7.84\times10^{-5}$ | $1.64\times10^{-3}$ | $2.08\times10^{-3}$ | $2.51\times10^{-3}$ | $3.10\times10^{-3}$ |
| 3.2 | $1.568\times10^{-4}$ | $3.28\times10^{-3}$ | $4.17\times10^{-3}$ | $5.03\times10^{-3}$ | $6.20\times10^{-3}$ |
| 6.4 | $3.136\times10^{-4}$ | $6.57\times10^{-3}$ | $8.34\times10^{-3}$ | $1.00\times10^{-2}$ | $1.24\times10^{-2}$ |

Table 6-2 shows molar surface coverage (moles/$m^2$) calculated as a function of solution concentration for Z6020 organosilane surface treatment as applied to the wound strings from a set of Rohrbacher Low-tension Titanium Acoustic Guitar Strings™. The theoretical dry-mass of the surface treatment is based on an estimated solution-deposition mass of $4.9\times10^{-3}$ g/inch (from EXAMPLE 3). The surface areas of strings ($m^2$ per inch) are calculated based on an assumption of cylindrical geometries for the component wires.

TABLE 6-2

| Organosilane solution concentration (% active ingredients by weight) | Theoretical dry-mass of surface treatment (g/inch) | Rohrbacher Low-tension "E" (d = 0.0525" $2.53 \times 10^{-4}$ $m^2$ per inch); moles/$m^2$ | Rohrbacher Low-tension "A" (d = 0.042" $2.14 \times 10^{-4}$ $m^2$ per inch); moles/$m^2$ | Rohrbacher Low-tension "D" (d = 0.032" $1.79 \times 10^{-4}$ $m^2$ per inch); moles/$m^2$ | Rohrbacher Low-tension "G" (d = 0.024" $1.44 \times 10^{-4}$ $m^2$ per inch); moles/$m^2$ |
|---|---|---|---|---|---|
| 0.05 | $2.45 \times 10^{-6}$ | $5.44 \times 10^{-5}$ | $6.43 \times 10^{-5}$ | $7.68 \times 10^{-5}$ | $9.55 \times 10^{-5}$ |
| 0.1 | $4.90 \times 10^{-6}$ | $1.08 \times 10^{-4}$ | $1.28 \times 10^{-4}$ | $1.53 \times 10^{-4}$ | $1.91 \times 10^{-4}$ |
| 0.2 | $9.80 \times 10^{-6}$ | $2.17 \times 10^{-4}$ | $2.57 \times 10^{-4}$ | $3.07 \times 10^{-4}$ | $3.82 \times 10^{-4}$ |
| 0.4 | $1.96 \times 10^{-5}$ | $4.35 \times 10^{-4}$ | $5.14 \times 10^{-4}$ | $6.15 \times 10^{-4}$ | $7.64 \times 10^{-4}$ |
| 0.8 | $3.92 \times 10^{-5}$ | $8.70 \times 10^{-4}$ | $1.02 \times 10^{-3}$ | $1.23 \times 10^{-3}$ | $1.52 \times 10^{-3}$ |
| 1.6 | $7.84 \times 10^{-5}$ | $1.74 \times 10^{-3}$ | $2.05 \times 10^{-3}$ | $2.46 \times 10^{-3}$ | $3.05 \times 10^{-3}$ |
| 3.2 | $1.568 \times 10^{-4}$ | $3.48 \times 10^{-3}$ | $4.11 \times 10^{-3}$ | $4.92 \times 10^{-3}$ | $6.11 \times 10^{-3}$ |
| 6.4 | $3.136 \times 10^{-4}$ | $6.96 \times 10^{-3}$ | $8.23 \times 10^{-3}$ | $9.84 \times 10^{-3}$ | $1.12 \times 10^{-2}$ |

Table 6-3 shows molar surface coverage (moles/$m^2$) calculated as a function of solution concentration for Z6020 organosilane surface treatment as applied to the wound strings from a set of Rohrbacher Medium Tension Titanium Acoustic Guitar Strings™. The theoretical dry-mass of the surface treatment is based on an estimated solution deposition mass of $4.9 \times 10^{-3}$ g/inch (from EXAMPLE 3). The surface areas of strings ($m^2$ per inch) are calculated based on an assumption of cylindrical geometries for the component wires.

TABLE 6-3

| Organosilane solution concentration (% active ingredients by weight) | Theoretical dry-mass of surface treatment (g/inch) | Rohrbacher Medium "E" (d = 0.055" $2.67 \times 10^{-4}$ $m^2$ per inch); moles/$m^2$ | Rohrbacher Medium "A" (d = 0.044" $2.25 \times 10^{-4}$ $m^2$ per inch); moles/$m^2$ | Rohrbacher Medium "D" (d = 0.034" $1.93 \times 10^{-4}$ $m^2$ per inch); moles/$m^2$ | Rohrbacher Medium "G" (d = 0.026" $1.60 \times 10^{-4}$ $m^2$ per inch); moles/$m^2$ |
|---|---|---|---|---|---|
| 0.05 | $2.45 \times 10^{-6}$ | $5.15 \times 10^{-5}$ | $6.11 \times 10^{-5}$ | $7.13 \times 10^{-5}$ | $8.60 \times 10^{-5}$ |
| 0.1 | $4.90 \times 10^{-6}$ | $1.03 \times 10^{-4}$ | $1.22 \times 10^{-4}$ | $1.42 \times 10^{-4}$ | $1.72 \times 10^{-4}$ |
| 0.2 | $9.80 \times 10^{-6}$ | $2.06 \times 10^{-4}$ | $2.44 \times 10^{-4}$ | $2.85 \times 10^{-4}$ | $3.44 \times 10^{-4}$ |
| 0.4 | $1.96 \times 10^{-5}$ | $4.12 \times 10^{-4}$ | $4.89 \times 10^{-4}$ | $5.70 \times 10^{-4}$ | $6.88 \times 10^{-4}$ |
| 0.8 | $3.92 \times 10^{-5}$ | $8.24 \times 10^{-4}$ | $9.78 \times 10^{-4}$ | $1.14 \times 10^{-3}$ | $1.37 \times 10^{-3}$ |
| 1.6 | $7.84 \times 10^{-5}$ | $1.64 \times 10^{-3}$ | $1.95 \times 10^{-3}$ | $2.28 \times 10^{-3}$ | $2.75 \times 10^{-3}$ |
| 3.2 | $1.568 \times 10^{-4}$ | $3.29 \times 10^{-3}$ | $3.91 \times 10^{-3}$ | $4.56 \times 10^{-3}$ | $5.50 \times 10^{-3}$ |
| 6.4 | $3.136 \times 10^{-4}$ | $6.59 \times 10^{-3}$ | $7.83 \times 10^{-3}$ | $9.12 \times 10^{-3}$ | $1.10 \times 10^{-2}$ |

Table 6-4 shows mass of surface treatment (calculated as a percentage of the total mass of the treated string) as a function of the solution concentration for an organosilane surface treatment as applied to the wound strings of a Rohrbacher Medium Tension Titanium Acoustic Guitar Strings™ set. The theoretical dry-mass of the surface treatment is based on an estimated solution deposition mass of $4.9 \times 10^{-3}$ g/inch (from EXAMPLE 3). The mass values of strings (grams per inch) are calculated values.

TABLE 6-4

| Organosilane solution concentration (% active ingredients by weight) | Theoretical dry-mass of surface treatment (g/inch) | Rohrbacher Medium "E" (d = 0.055" 0.2690 grams per inch); % treatment by total mass | Rohrbacher Medium "A" (d = 0.044" 0.1633 grams per inch); % treatment by total mass | Rohrbacher Medium "D" (d = 0.034" 0.0916 grams per inch); % treatment by total mass | Rohrbacher Medium "G" (d = 0.026" 0.0496 grams per inch); % treatment by total mass |
|---|---|---|---|---|---|
| 0.05 | $2.45 \times 10^{-6}$ | $9.1 \times 10^{-4}$ | $1.5 \times 10^{-3}$ | $2.6 \times 10^{-3}$ | $4.9 \times 10^{-3}$ |
| 0.1 | $4.90 \times 10^{-6}$ | $1.8 \times 10^{-3}$ | $3.0 \times 10^{-3}$ | $5.3 \times 10^{-3}$ | $9.8 \times 10^{-3}$ |
| 0.2 | $9.80 \times 10^{-6}$ | $3.6 \times 10^{-3}$ | $6.0 \times 10^{-3}$ | $1.0 \times 10^{-2}$ | $1.9 \times 10^{-2}$ |
| 0.25 | $1.22 \times 10^{-5}$ | $4.5 \times 10^{-3}$ | $7.4 \times 10^{-3}$ | $1.3 \times 10^{-2}$ | $2.4 \times 10^{-2}$ |
| 0.30 | $1.47 \times 10^{-5}$ | $5.4 \times 10^{-3}$ | $9.0 \times 10^{-3}$ | $1.6 \times 10^{-2}$ | $2.9 \times 10^{-2}$ |
| 0.35 | $1.71 \times 10^{-5}$ | $6.3 \times 10^{-3}$ | $1.0 \times 10^{-2}$ | $1.8 \times 10^{-2}$ | $3.4 \times 10^{-2}$ |
| 0.4 | $1.96 \times 10^{-5}$ | $7.2 \times 10^{-3}$ | $1.2 \times 10^{-2}$ | $2.1 \times 10^{-2}$ | $3.9 \times 10^{-2}$ |
| 0.8 | $3.92 \times 10^{-5}$ | $1.4 \times 10^{-2}$ | $2.4 \times 10^{-2}$ | $4.2 \times 10^{-2}$ | $7.9 \times 10^{-2}$ |
| 1.0 | $4.90 \times 10^{-5}$ | $1.8 \times 10^{-2}$ | $2.9 \times 10^{-2}$ | $5.3 \times 10^{-2}$ | $9.8 \times 10^{-2}$ |
| 6.4 | $3.13 \times 10^{-4}$ | 0.12 | 0.19 | 0.34 | 0.63 |

When combined with the relative corrosion data of EXAMPLE 2, the methods of the present example can be used to define a range of preferred molar surface concentrations, which in turn can be used to determine the solution concentration that is required for deposition of an organosilane onto any given string construction. The data of EXAMPLE 2 show that the corrosion resistance of "A" strings is improved with solution treatment concentrations ranging from between 0 (i.e., about 0.005%) and 0.05% Z6020 by weight at the lower limit, to between 1.6% and 3.2% Z6020 by weight at upper limit. Using the calculations for "A" strings in Tables 6-1, and 6-2, these solution concentrations equate to molar surface concentrations of between approximately $10.0\times10^{-6}$ (i.e., for near-monolayer coverage) and $6.5\times10^{-5}$ moles/m$^2$ at the lower limit, to between about $2.0\times10^{-3}$ and $4.1\times10^{-3}$ moles/m$^2$ at upper limit. This range represents a preferred range of molar surface concentrations (independent of string construction) that is required to achieve the unexpected benefit of improved corrosion resistance. When applied to the other string constructions in Tables 6-1, 6-2, and 6-3, the preferred range of molar surface concentrations can be achieved with similar solution concentrations ranging again from between about 0.005% and 0.05% Z6020 by weight at the lower limit, to between about 1.6% and 3.2% Z6020 by weight at upper limit.

The data of EXAMPLE 2 also show that the degree of corrosion protection increases with increasing solution concentration up to and beyond an optimum concentration, where the optimum improvement occurs at between about 0.05% and 0.4% Z6020 by weight for the Rohrbacher low-tension titanium-core "A" strings, and between about 0.1% and 1.6% Z6020 by weight for the DR steel-core "A" strings. According to the calculations of the present example, these concentrations equate to molar surface concentrations of between about $6.43\times10^{-5}$ and $5.14\times10^{-4}$ moles/m$^2$ for phosphor bronze wound titanium alloy cores (see Table 6-2); and between about $6.52\times10^{-5}$ and $2.08\times10^{-3}$ moles/m$^2$ for phosphor bronze wound steel cores (see Table 6-1).

With the knowledge of a target surface concentration, an optimum solution concentration can be approximated for any string construction. For example, Table 6-5 provides the Z6020 solution concentrations (calculated as a percentage by weight of the solvent carrier) required to achieve equal molar surface coverage ($2.57\times10^{-4}$ moles/m$^2$) on all wound strings of a phosphor bronze wound set of Rohrbacher Medium Tension Titanium Acoustic Guitar Strings™. The theoretical dry-mass of the surface treatment is based on an estimated solution deposition mass of $4.9\times10^{-3}$ g/inch (from EXAMPLE 3). The surface areas of strings (m$^2$ per inch) are calculated based on an assumption of cylindrical geometries for the component wires.

TABLE 6-5

| String Construction | Theoretical dry-mass of surface treatment for equal molar surface coverage (g/inch) | Mass of surface treatment (% of total mass of treated string) | Theoretical solution concentration for equal molar surface coverage (% by weight) |
|---|---|---|---|
| Rohrbacher Medium "E" (d = 0.055"; 0.2690 grams per inch; $2.67\times10^{-4}$ m$^2$ per inch) | $1.22\times10^{-5}$ | $4.54\times10^{-3}$ | 0.248% |

TABLE 6-5-continued

| String Construction | Theoretical dry-mass of surface treatment for equal molar surface coverage (g/inch) | Mass of surface treatment (% of total mass of treated string) | Theoretical solution concentration for equal molar surface coverage (% by weight) |
|---|---|---|---|
| Rohrbacher Medium "A" (d = 0.044"; 0.1633 grams per inch; $2.25\times10^{-4}$ m$^2$ per inch) | $1.03\times10^{-5}$ | $6.31\times10^{-3}$ | 0.210% |
| Rohrbacher Medium "D" (d = 0.034"; 0.0916 grams per inch; $1.93\times10^{-4}$ m$^2$ per inch) | $8.82\times10^{-6}$ | $9.63\times10^{-3}$ | 0.180% |
| Rohrbacher Medium "G" (d = 0.026"; 0.0496 grams per inch; $1.60\times10^{-4}$ m$^2$ per inch) | $7.32\times10^{-6}$ | $1.48\times10^{-2}$ | 0.149% |

Alternatively, the wound strings as presented in Table 6-5 could be treated with a single solution comprising at least about 0.25% of active ingredients, so that the target surface coverage value ($2.57\times10^{-4}$ moles/m$^2$) becomes a nominal value for all of the wound strings.

EXAMPLE 7

Based on the combined data from EXAMPLES 2, 3, 4, 5, and 6, it can be appreciated that by using the surface treatments and methods of the present invention, a variety of strings can be produced that have the combined characteristics of excellent corrosion resistance and excellent tonal characteristics. One superior example includes a plural set of surface-treated Rohrbacher Medium Tension Titanium Acoustic Guitar Strings™ for use with acoustic guitar.

In this example, a set of Rohrbacher Medium Tension Phosphor Bronze wound Titanium Acoustic Guitar Strings™ was treated sequentially with a primary organosilane treatment solution, followed by a secondary organosilane treatment solution. The treated strings (comprising two separate, monolithic organosilane surface treatment layers) were then qualitatively evaluated for their acoustic characteristics, playability, and longevity in use. In addition, the data of EXAMPLE 3 and methods of EXAMPLE 6 were used to estimate the mass percentage and molar surface concentration of the organosilane surface treatments that were deposited onto each wound string.

The primary organosilane solution was comprised of prehydrolyzed Z6020, diluted to a concentration of 0.19% active ingredients by weight in 70/30 (v/v) IPA/water (according to the procedures of EXAMPLE 2). The second solution was prepared by adding Fluorolink™ S-10 to a solution containing 0.166% by weight acetic acid in 70/30 (v/v) EPA/water, to yield a secondary organosilane solution containing 0.166% S-10 by weight, and 0.166% acetic acid by weight. Both organosilane solutions were aged under ambient conditions for a period of 24 hours prior to use.

Each wound string was separately dipped into the primary organosilane solution for one minute, and then was flash dried with a hot-air gun (at a temperature of approximately 150° C.) for a 2 second dwell time. The strings were hung vertically and were allowed to equilibrate under ambient conditions for approximately 30 minutes. Each monolithically treated wound string was then separately dipped into the secondary organosilane solution for a period of 30 seconds, and was then flash dried with a hot-air gun (at a temperature of approximately 150° C.) for a 2 second dwell time. The strings were again hung vertically and were allowed to equilibrate under ambient conditions for approximately 45 minutes. The strings were then placed into a pre-heated gravity oven to bake at a temperature of 96° C. for a period of 1 hour.

Table 7-1 provides an estimate of the mass contribution from each organosilane component for each string, together with an estimate of the molar surface coverage for the primary organosilane. The theoretical dry-mass of the Z6020 and S-10 surface treatments are based on an estimated solution deposition mass of $4.9\times10^{-3}$ g/inch (from EXAMPLE 3). The surface areas of strings (m per inch) are calculated based on an assumption of cylindrical geometries for the component wires. The theoretical dry-mass of each surface treatment is calculated as a percentage of the total mass of each treated string. The mass values of strings (grams per inch) are calculated values.

TABLE 7-1

| String Construction | Theoretical dry-mass of Z6020 surface treatment (g/inch) | Theoretical dry-mass of S-10 surface treatment (g/inch) | Total mass % treatment (% of total mass of treated string) | Molar surface coverage of the Z6020 primary organosilane (moles/$m^2$) |
|---|---|---|---|---|
| Rohrbacher Medium "E" (d = 0.055"; 0.2690 grams per inch; $2.67 \times 10^{-4}$ $m^2$ per inch) | $9.31 \times 10^{-6}$ | $8.13 \times 10^{-6}$ | $6.48 \times 10^{-3}$ | $1.95 \times 10^{-4}$ |
| Rohrbacher Medium "A" (d = 0.044"; 0.1633 grams per inch; $2.25 \times 10^{-4}$ $m^2$ per inch) | $9.31 \times 10^{-6}$ | $8.13 \times 10^{-6}$ | $1.06 \times 10^{-2}$ | $2.32 \times 10^{-4}$ |
| Rohrbacher Medium "D" (d = 0.034"; 0.0916 grams per inch; $1.93 \times 10^{-4}$ $m^2$ per inch) | $9.31 \times 10^{-6}$ | $8.13 \times 10^{-6}$ | $1.90 \times 10^{-2}$ | $2.71 \times 10^{-4}$ |
| Rohrbacher Medium "G" (d = 0.026"; 0.0496 grams per inch; $1.60 \times 10^{-4}$ $m^2$ per inch) | $9.31 \times 10^{-6}$ | $8.13 \times 10^{-6}$ | $3.51 \times 10^{-2}$ | $3.26 \times 10^{-4}$ |

Upon removal from the oven, the strings were strung onto a Seagull "Artist Series" acoustic guitar, and were tuned to conventional pitch values for "bass-E", "A," "D," and "G," respectively. The strings provided excellent initial tonal qualities with a degree of brightness that is characteristic of new strings. The strings were played extensively for a period of three months. During this period, the strings maintained their excellent tonal characteristics with no signs of visible discoloration from corrosion.

It is to be appreciated that certain features of the present invention may be changed without departing from the overall scope of the present invention. Thus, for example, it is to be appreciated that although the invention has been described in terms of a preferred embodiment in which organosilane surface treated, low stiffness, corrosion resistant musical instrument strings are constructed with titanium alloy-cores, and in which methods for achieving said corrosion resistance without affecting acoustic characteristics are disclosed; the musical instrument strings comprehended by the present invention can include any metal or non-metal core that is capable of delivering the desired combination of physical properties for a musical instrument string including low elongation under stress, low stress relaxation, high yield stress, and high tensile stress. Windings may include any from a variety of commercially available materials, but copper alloys will particularly benefit from the organosilane surface treatments as disclosed herein. The organosilane surface treatment could be of any variety, and could be combined with other surface treatments including any compound from the broad family of azole compounds, such as benzotriazole. However, in accordance with the findings herein, the preferred organosilane is one that contains at least one component comprising an aminosilane, where a substantial fraction of the amine groups are non-protonated, or free to associate with the metallic surfaces. Although the preferred organosilane treatments have been demonstrated for use on wound strings, it can be appreciated that the methods of surface treatment and corrosion protection can be equally combined with other technologies if so desired, including ones where ductile metals coat the core over the length of the string, or where organic polymers or plasma coatings are used to cover or coat either a portion of, or the entire wound structure (before or after the application of the organosilane treatment). It can likewise be appreciated that the organosilane surface treatments of the present invention can also be used to improve the performance characteristics of non-wound musical instrument strings.

Whereas the preferred embodiments of the present invention have been described above in terms of musical instrument strings for guitars, and other stringed instruments such as violins, cellos, dulcimers, banjos, mandolins, basses, pianos, etc., it will be apparent to those skilled in the art that the present invention will also be valuable with other devices which employ wound structures such as resistors, springs, tennis rackets, fishing equipment, marine equipment, jewelry, etc. In addition, the novel surface treatments as described in this invention could be employed as surface treatments for copper alloys, metallic wires, and other metal surfaces for use in a multitude of applications where enhanced corrosion protection is desired.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

What is claimed is:

1. A musical instrument string comprising a ceramic, metallic or polymeric core member and a metallic wrap wire member helically wound about said core wire, wherein one or both members are surface treated separately or in combination, with one or more organosilane compounds selected from the group consisting of monomers, hydrolyzed monomers, hydrolyzed dimers, oligomers, and condensation products of a trialkoxysilane or a bis-trialkoxysilane.

2. A musical instrument string as recited in claim 1, wherein the core member is comprised of a monofilament nylon polymer, a titanium wire, a titanium alloy wire, a stainless steel wire, or a steel wire.

3. A musical instrument string as recited in claim 1, wherein the wrap wire member is a copper alloy wire, a brass wire, a phosphor bronze wire, a nickel alloy wire, a nickel wire, a steel wire, a stainless steel wire, or a nickel plated steel wire.

4. A musical instrument string as recited in claim 1, wherein the one or more organosilane compounds include surface adsorbed condensation products of one or more trialkoxysilane compounds selected from the group consisting of monomers, hydrolyzed monomers, hydrolyzed dimers, and hydrolyzed oligomers of an aminopropyltrialkoxysilane, an aminoethylaminopropyltrialkoxysilane, an alkytrialkoxysilane, a vinyltrialkoxysilane, a phenyltrialkoxysilane, a mercaptotrialkoxysilane, a styrylaminotrialkoxysilane, a methacryloxypropyltrialkoxysilane, a glycidoxypropyltrialkoxysilane, a perfluorotrialkoxysilane, a perfluoroether functionalized trialkoxysilane, an azole functional trialkoxysilane, and mixtures thereof.

5. A musical instrument string as recited in claim 1, wherein the one or more organosilane compounds include the surface adsorbed condensates of one or more compounds selected from the group consisting of monomers, hydrolyzed monomers, hydrolyzed dimers, and hydrolyzed oligomers of an amino functional trialkoxysilane, wherein said surface adsorbed condensates of said organosilane are comprised of a substantial fraction of non-protonated amine groups.

6. A musical instrument string as recited in claim 1, wherein said one or more organosilane compounds comprise a single monolithic layer, and wherein said monolithic layer is surface adsorbed separately onto one or both the core and wrap wire members, or is surface adsorbed onto the helically wound string comprising the core and wrap wire members in combination.

7. A musical instrument string as recited in claim 1, wherein said one or more organosilane compounds comprise one or more monolithic layers in combination, and wherein one or more of said monolithic layers are surface adsorbed separately onto one or both the core and wrap wire members, or are surface adsorbed onto the helically wound string comprising the core and wrap wire members in combination.

8. A musical instrument string as recited in claim 1, wherein said one or more organosilanes comprises a first organosilane having condensates adsorbed on the metal surfaces, wherein said condensates are comprised of one or more compounds selected from the group consisting of monomers, hydrolyzed monomers, hydrolyzed dimers, and hydrolyzed oligomers of an amino functional trialkoxysilane, wherein said surface adsorbed condensates of said first organosilane are comprised of a substantial fraction of non-protonated amine groups, and where one or more subsequent organosilanes comprise a second monolithic layer overlaying said first organosilane.

9. A musical instrument string as recited in claim 1, wherein said one or more organosilanes comprises a mixture of two or more organosilanes, wherein at least one organosilane comprises the surface adsorbed condensates of one or more compounds selected from the group consisting of monomers, hydrolyzed monomers, hydrolyzed dimers, and hydrolyzed oligomers of an amino functional trialkoxysilane, reacted and condensed together with at least one additional organosilane compound, wherein a substantial fraction of the amino groups of said surface adsorbed condensates are non-protonated amine groups.

10. A musical instrument string comprising either a titanium, a titanium alloy, a stainless steel, or a steel wire core member, and a metallic wrap wire member comprising either a copper alloy wire, a brass wire, a phosphor bronze wire, a nickel alloy wire, a nickel wire, a steel wire, a stainless steel wire, or a nickel plated steel wire, wherein said wrap wire is helically wound about said core wire, wherein one or both members are surface treated separately or in combination with a first monolithic layer comprising one or more of the surface adsorbed condensation products of an amino functional trialkoxysilane or an amino functional bis-trialkoxysilane compound, separately or in combination with an optional second organosilane selected from the group consisting of monomers. hydrolyzed monomers, hydrolyzed dimers. oligomers, and condensation products of a trialkoxysilane or a bis-trialkoxysilane, wherein the sum total mass contribution of said first monolithic layer constitutes less than 1% of the mass of the finished string.

11. A musical instrument string as recited in claim 10, wherein the one or both members are treated with a second monolithic layer comprising the condensation products of an organosilane compound selected from the group consisting of monomers, hydrolyzed monomers, hydrolyzed dimers, and oligomers of a trialkoxysilane or a bis-trialkoxysilane.

12. musical instrument string as recited in claim 10, wherein a substantial fraction of the amine groups of the first monolithic layer are non-protonated.

13. A musical instrument string as recited in claim 10, wherein the amino functional trialkoxysilane is selected from the group consisting of monomers, hydrolyzed monomers, hydrolyzed dimers, and hydrolyzed oligomers of either N-2-aminoethyl-3-aminopropyltrimethoxysilane, N-2-aminoethyl-3-aminopropyltriethoxysilane, aminopropyltrimethoxysilane, aminopropyltriethoxysilane, or mixtures thereof.

14. A musical instrument string as recited in claim 10, wherein the second organosilane of the first monolithic layer, if present, is selected from the group consisting of monomers, hydrolyzed monomers, hydrolyzed dimers, and hydrolyzed oligomers of a perfluoroalkoxvsilane, a bis-trialkoxysilane, an alkyltrialkoxysilane, a perfluoroether functionalized trialkoxysilane, a fluoro functionalized alkoxysilanes, and mixtures thereof.

15. A musical instrument string as recited in claim 11, wherein the second monolithic layer comprises the condensation products of an organosilane selected from the group consisting of one or more of the monomers, hydrolyzed monomers, hydrolyzed dimers, and hydrolyzed oligomers of a fluoro functionalized alkoxysilane, a bis-trialkoxysilane, an alkyltrialkoxysilane, a perfluoroether functionalized trialkoxysilane, and mixtures thereof.

16. A musical instrument string as recited in claim 10, wherein the sum total mass contribution of all organosilane components constitutes less than 0.1% of the mass of the finished string.

17. A musical instrument string as recited in claim 10, wherein the sum total mass contribution of all organosilane components constitutes between 0.0009% and 0.05% of the mass of the finished string.

18. A musical instrument string as recited in claim 10, wherein the sum total surface concentration of all organosilane components constitutes between $10.0\times10^{-6}$ moles/m$^2$ to and $3.0\times10^{-3}$ moles/m$^2$.

19. A musical instrument string as recited in claim 10, wherein the sum total surface concentration of all organosilane components constitutes between $5.0\times10^{-5}$ and $9.0\times10^{-4}$ moles/$m^2$.

20. A method of surface treating a musical instrument string comprising providing a ceramic, metallic or polymeric core member and a metallic wrap wire member helically wound about said core wire, and treating a surface of one or both members separately or in combination, with at least one organosilane compound selected from the group consisting of monomers, hydrolyzed monomers, hydrolyzed dimers, oligomers, and condensation products of a trialkoxysilane or a bis-trialkoxysilane, wherein the sum total mass contribution of all surface adsorbed organosilane compounds or condensates constitutes less than 1.0% of the mass of the finished string.

21. A method of surface treating a musical instrument string as recited in claim 20, wherein the core member is selected from the group consisting of a monofilament nylon polymer, a titanium wire, a titanium alloy wire, a stainless steel wire, or a steel wire, the wrap wire member is selected from the group consisting of a copper alloy wire, a brass wire, a phosphor bronze wire, a nickel alloy wire, a nickel wire, a steel wire, a stainless steel wire, or a nickel plated steel wire, and the at least one organosilane compound is selected from the group consisting of trialkoxysilane monomers, hydrolyzed trialkoxysilane monomers, hydrolyzed dimers of trialkoxysilane, and hydrolyzed oligomers of a trialkoxysilane, bis-trialkoxysilane monomers, hydrolyzed bis-trialkoxysilane monomers, hydrolyzed dimers of bis-trialkoxysilanes, hydrolyzed oligomers of a bis-trialkoxysilane, and mixtures thereof.

22. A method of surface treating a musical instrument string as recited in claim 20, wherein said trialkoxysilane includes at least one or more compounds selected from the group consisting of monomers, prehydrolyzed monomers, prehydrolyzed dimers, and prehydrolyzed oligomers of an aminopropyltrialkoxysilane, an aminoethylaminopropyltrialkoxysilane, and optionally one or more compounds selected from the group consisting of monomers, prehydrolyzed monomers, prehydrolyzed dimers, and prehydrolyzed oligomers of an alkytrialkoxysilane, a vinyltrialkoxysilane, a phenyltrialkoxysilane, a mercaptotrialkoxysilane, a styrylaminotrialkoxysilane, a methacryloxypropyltrial koxysilane, a glycidoxypropyltrialkoxysilane, a perfluorotrialkoxysilane, a perfluoroether functionalized trialkoxysilane, an azole functional trialkoxysilane, and mixtures thereof.

23. A non-wound musical instrument string comprising a metallic wire that has been surface treated with one or more monolithic layers comprising the condensation products of one or more organosilane compounds selected from the group consisting of monomers, hydrolyzed monomers, hydrolyzed dimers, and oligomers of a trialkoxysilane or a bis-trialkoxysilane, wherein the sum total mass contribution of all monolithic layers constitutes less than 1.0% of the mass of the finished string.

24. A non-wound musical instrument string as recited in claim 23, wherein the metallic wire is a steel, a steel alloy, a titanium alloy, or a music spring wire.

25. A method of forming a corrosion resistant musical instrument string comprising a metallic wire utilizing at least one organosilane compound as a surface treatment, wherein said organosilane compound is selected from the group consisting of monomers, hydrolyzed monomers, hydrolyzed dimers, oligomers, and condensation products of a trialkoxysilane or a bis-trialkoxysilane, and wherein the sum total mass contribution of all organosilane condensation products constitutes less than 1.0% of the mass of the finished string.

26. A musical instrument string as recited in claim 1, wherein the sum total mass contribution of all organosilane condensation products comprising said surface treatment constitutes less than 1 .0% of the mass of the finished string.

27. A musical instrument string as recited in claim 1, wherein said trialkoxysilane is given by the general formula $$(RO)_3Si\text{-}R'$$

where R is one or more of either a propyl, ethyl, methyl, isopropyl, butyl, isobutyl, sec- butyl, t-butyl, or acetyl group, and R' is an organofunctional group comprised of one or more of an aminopropyl group, an aminoethylaminopropyl group, an alky group, a vinyl group, a phenyl group, a mercapto group, a styrylamino group, a methacryloxypropyl group, a glycidoxy group, a perfluoro group, a perfluoroether group, an azole group, or an imidazole group, and wherein said bistrialkoxysilane is given by the general formula $$(RO)_3Si\text{-}R'\text{-}Si(RO)_3$$

where R is one or more of either a propyl, ethyl, methyl, isopropyl, butyl, isobutyl, sec-butyl, t-butyl, or acetyl group, and R'is a bridging organofunctional residue comprised of functionality selected from the group consisting of one or more of amino groups, alky groups, vinyl groups, phenyl groups, mercapto groups, perfluoro groups, or perfluoroether groups.

* * * * *